United States Patent [19]

Mitchell

[11] Patent Number: 4,650,424

[45] Date of Patent: Mar. 17, 1987

[54] EDUCATIONAL DEVICE AND METHOD

[76] Inventor: Maurice E. Mitchell, 601 Terra California, Walnut Creek, Calif. 94595

[21] Appl. No.: 754,920

[22] Filed: Jul. 15, 1985

Related U.S. Application Data

[63] Continuation-in-part of Ser. No. 628,209, Jul. 5, 1984, abandoned, and Ser. No. 614,050, May 25, 1984, abandoned, and Ser. No. 430,316, Sep. 30, 1982, Pat. No. 4,461,480, and Ser. No. 430,315, Sep. 30, 1982, abandoned.

[51] Int. Cl.[4] ..... G09B 23/04

[52] U.S. Cl. ..... 434/211; 52/DIG. 10; 273/157 R; 434/403; 446/85; 446/92

[58] Field of Search ..... 434/211, 277, 278, 281, 434/403; 273/157 R; 446/85, 92; 52/DIG. 10

[56] References Cited

U.S. PATENT DOCUMENTS

| | | | |
|---|---|---|---|
| 3,837,652 | 9/1974 | Kuwagaki et al. | 273/157 R |
| 3,945,645 | 3/1976 | Roberts | 273/157 R |
| 3,998,003 | 12/1976 | Rosenbaum | 434/278 X |
| 4,014,110 | 3/1977 | Mayer | 434/277 |
| 4,060,247 | 11/1977 | Kobres | 273/157 R |
| 4,271,628 | 6/1981 | Barlow | 434/403 X |

OTHER PUBLICATIONS

*Order in Space,* by Keith Critchlow, The Viking Press, pp. 3–10.

*Primary Examiner*—William H. Grieb
*Attorney, Agent, or Firm*—Hall, Myers & Rose

[57] ABSTRACT

An educational toy and method for demonstrating characteristics of a latticework of spacepoints including demonstrating (a) the commonality of latticework between tetrahedron configuration latticework and octahedron configuration latticework, (b) that octahedron latticework merges with tetrahedron latticework, (c) the 13-plane structure of the common latticework, (d) how simultaneous twinning in more than one of the 13 planes can form multitudes of combinations of domains of tetrahedrons and octahedrons, and (e) the altering of latticework by appropriately selecting the dimensions of structure members that define spacepoints in the latticework. Preferably, the structure members are similarly dimensioned and oriented ellipsoidal elements which are gravity stacked and optionally connectable and wherein the centerpoint of each ellipsoidal element represents a spacepoint in the latticework. With ellipsoidal elements, the latticework structure is determined by the relative lengths of the three orthogonal axes of symmetry of the ellipsoidal elements when the common axis and the location of either orientation mark are known.

56 Claims, 31 Drawing Figures

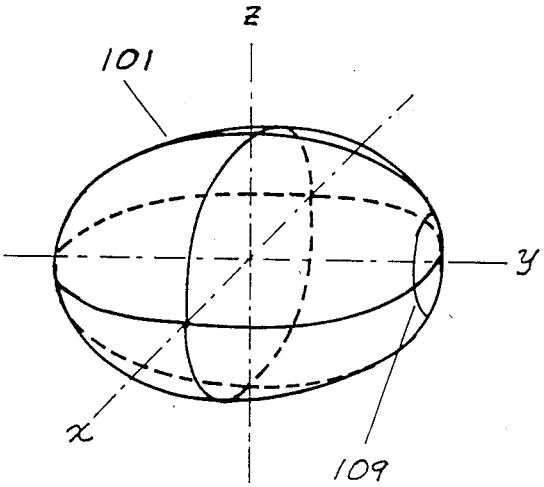
FIG. 1.0
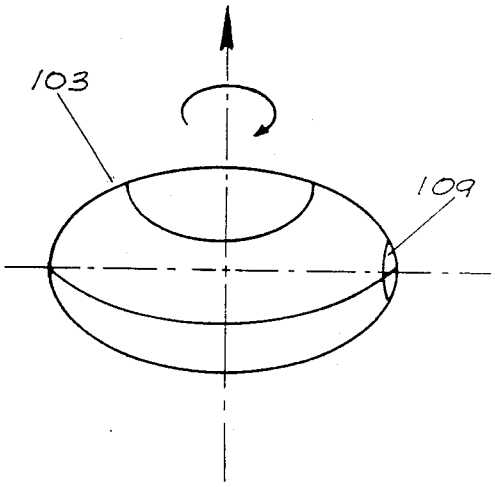
FIG. 1.1
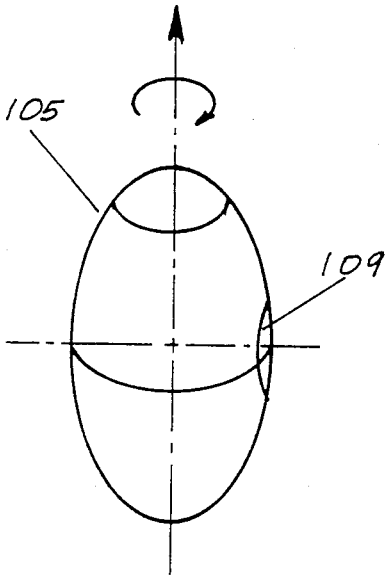
FIG. 1.2
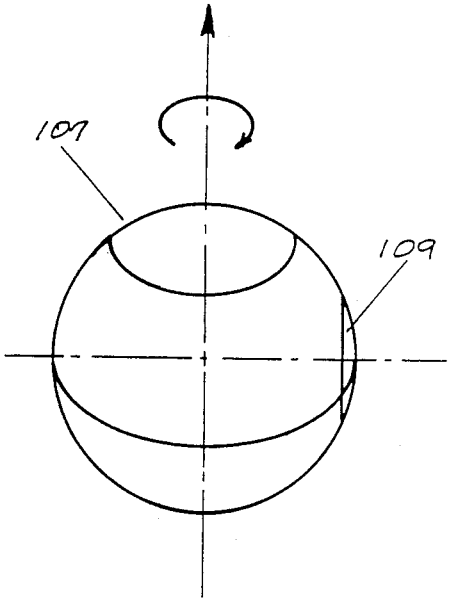
FIG. 1.3

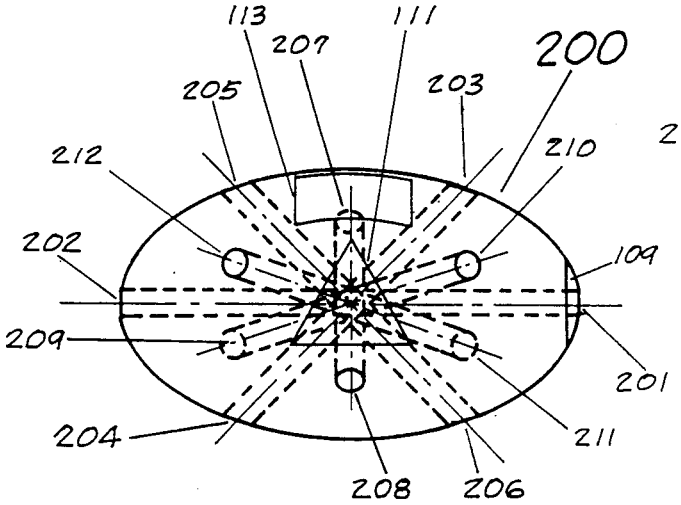
FIG. 2.0
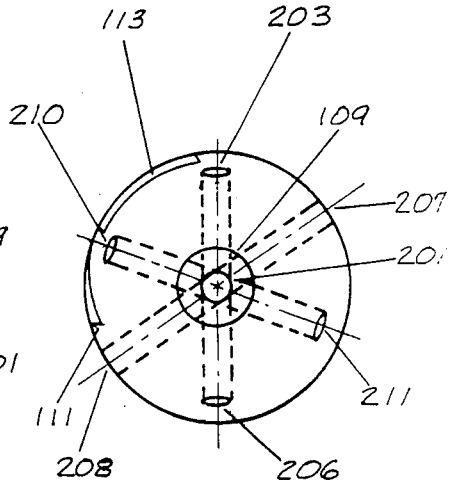
FIG. 2.1
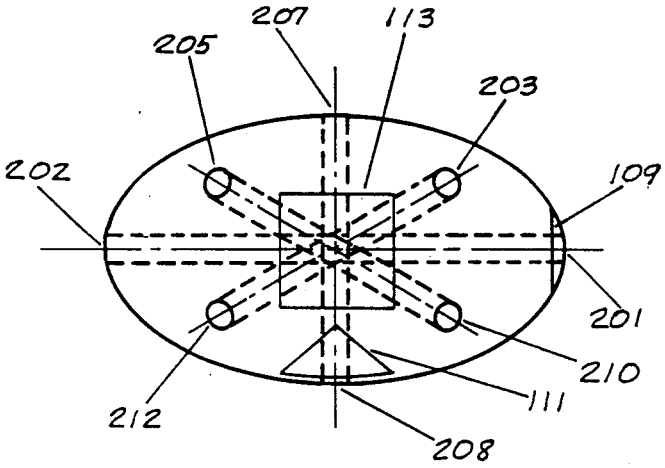
FIG. 2.2
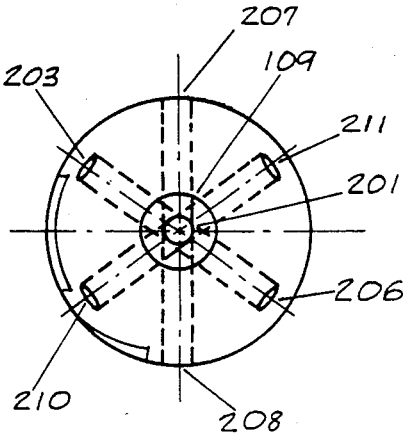
FIG. 2.3

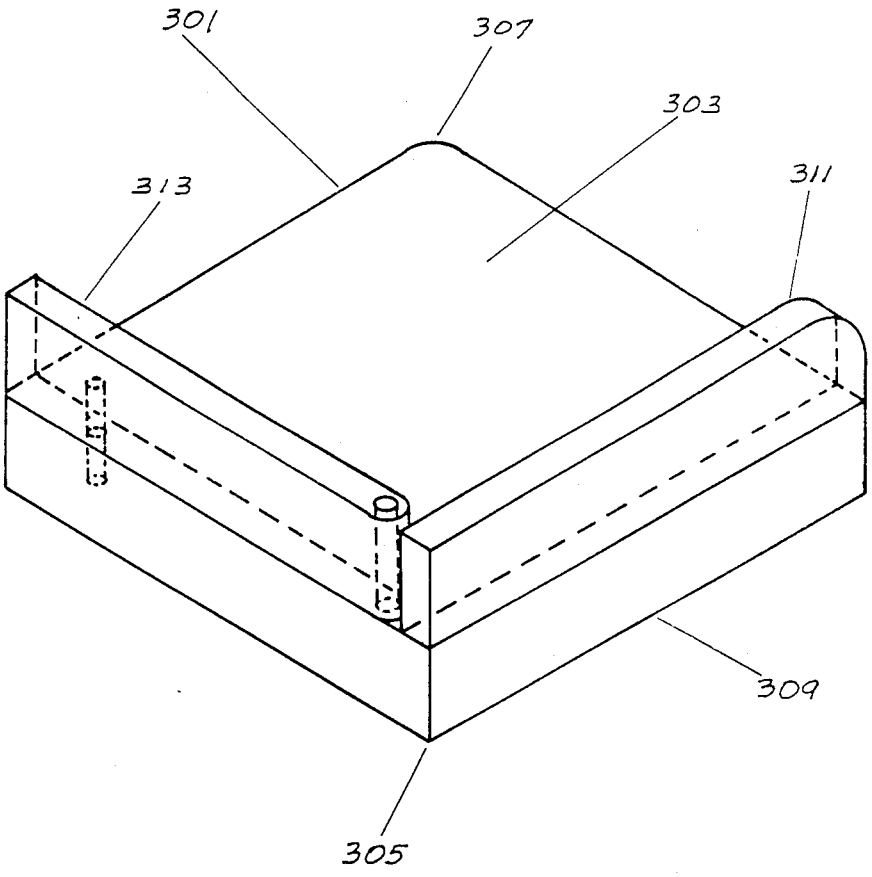
FIG. 3.0

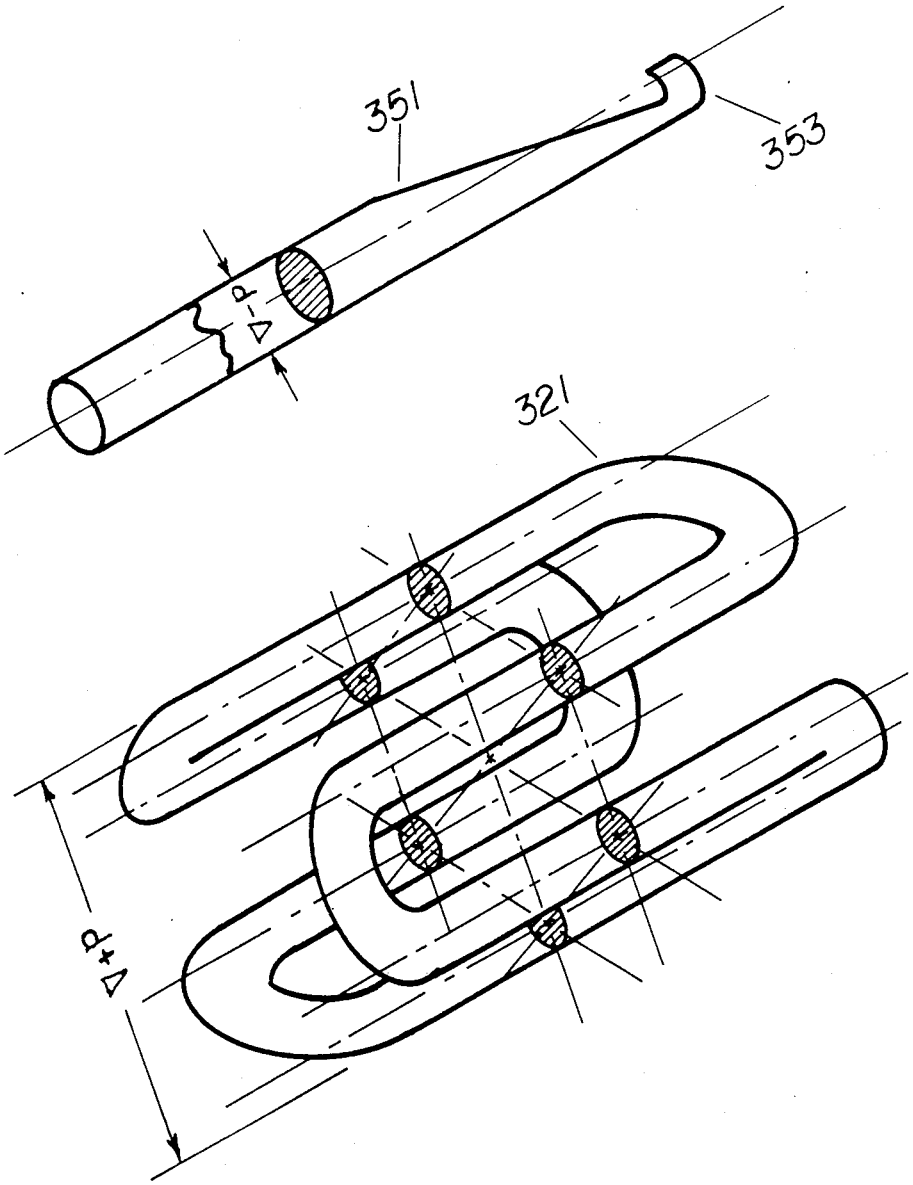
FIG. 3.1

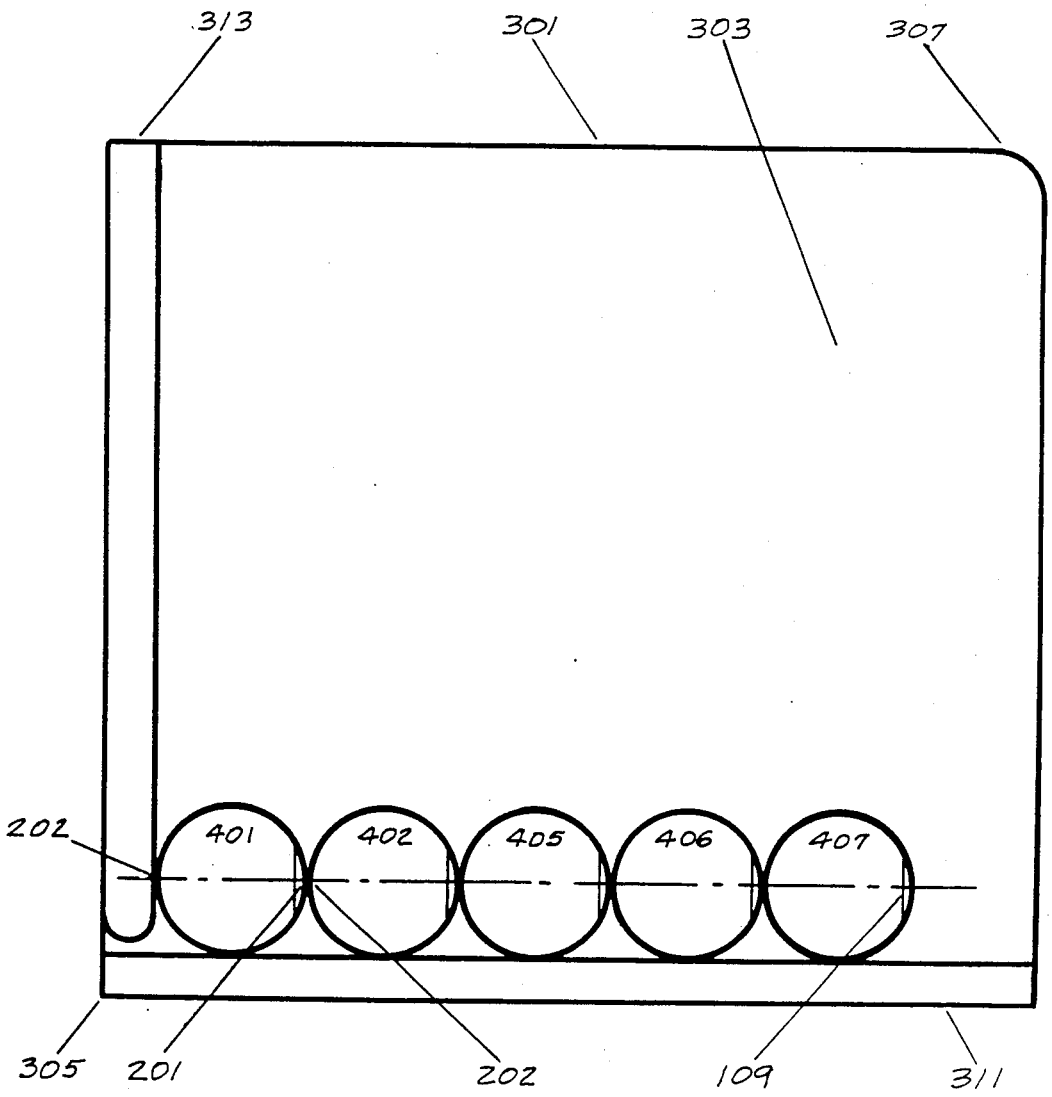
FIG. 4.0

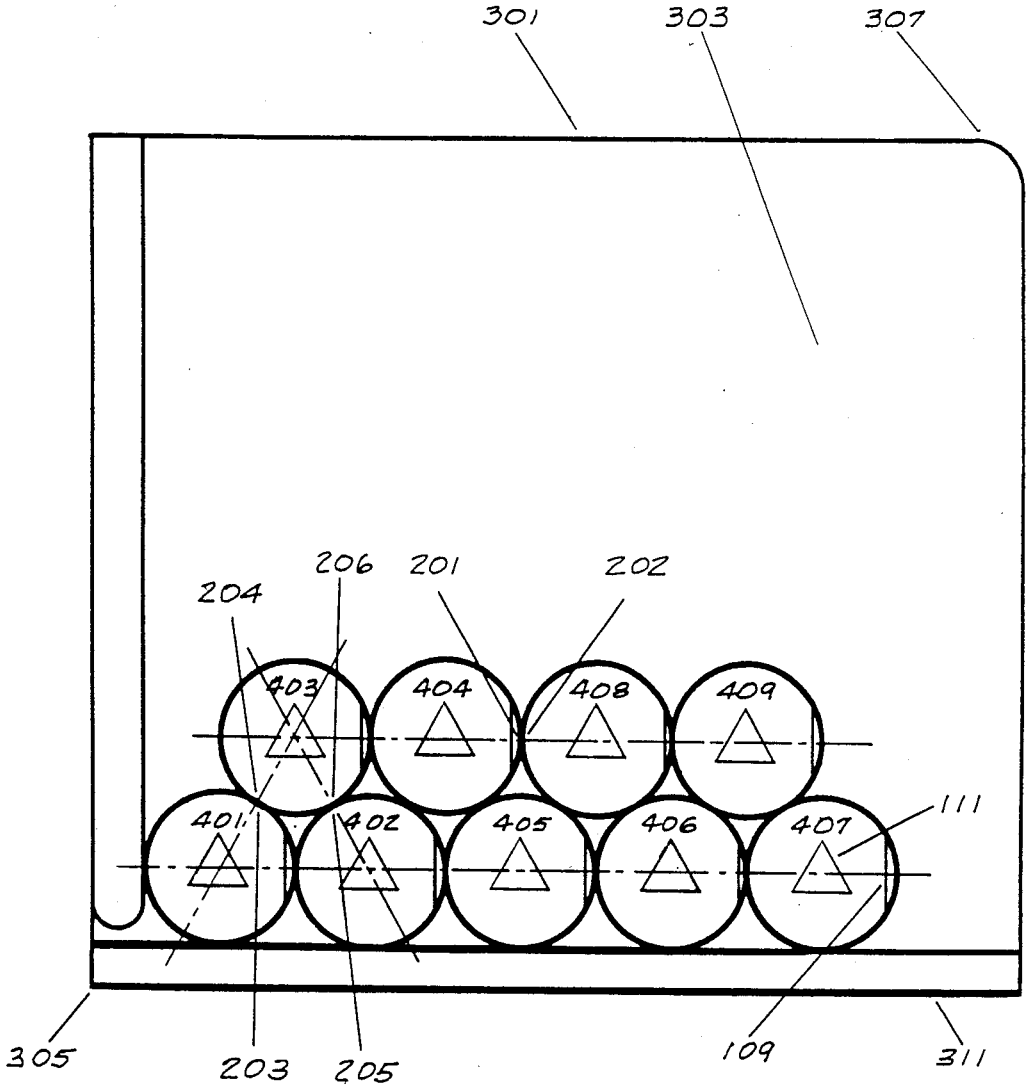
FIG. 4.1

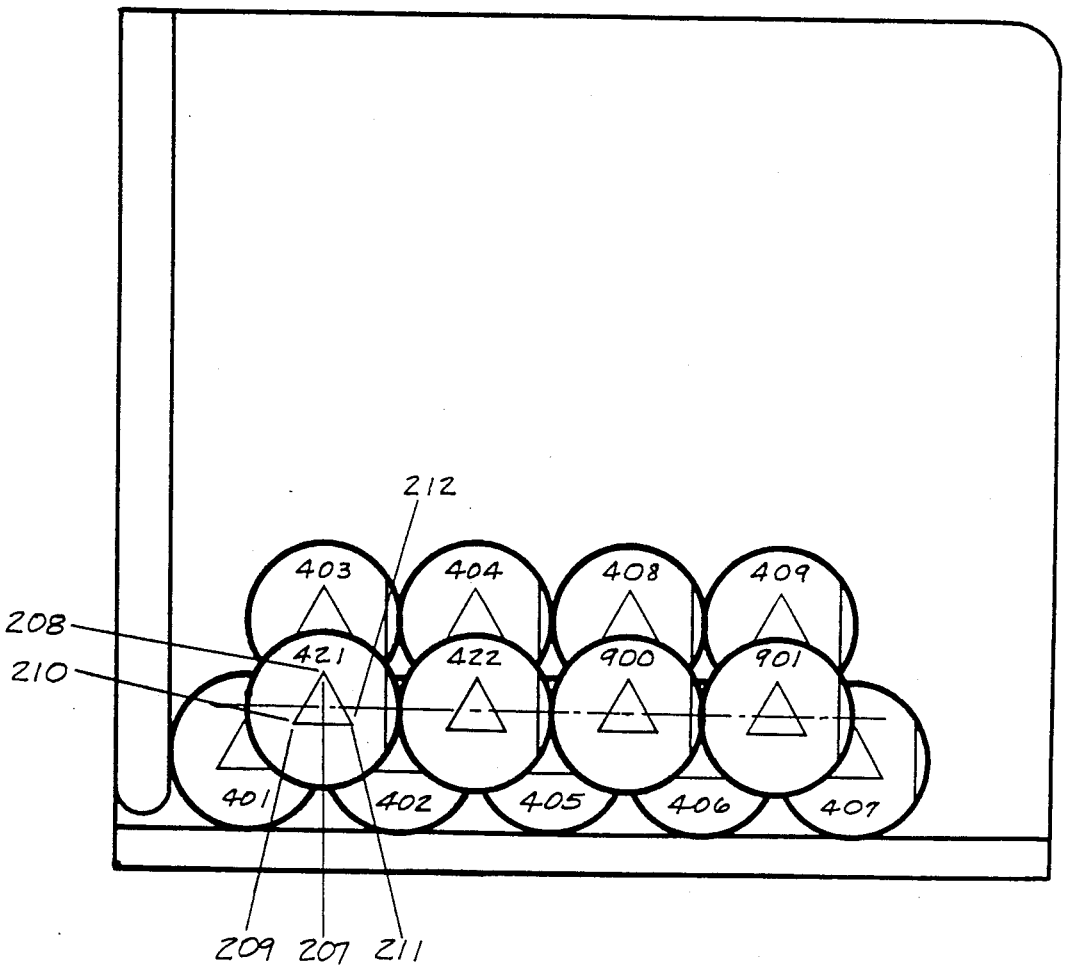
FIG. 4.2

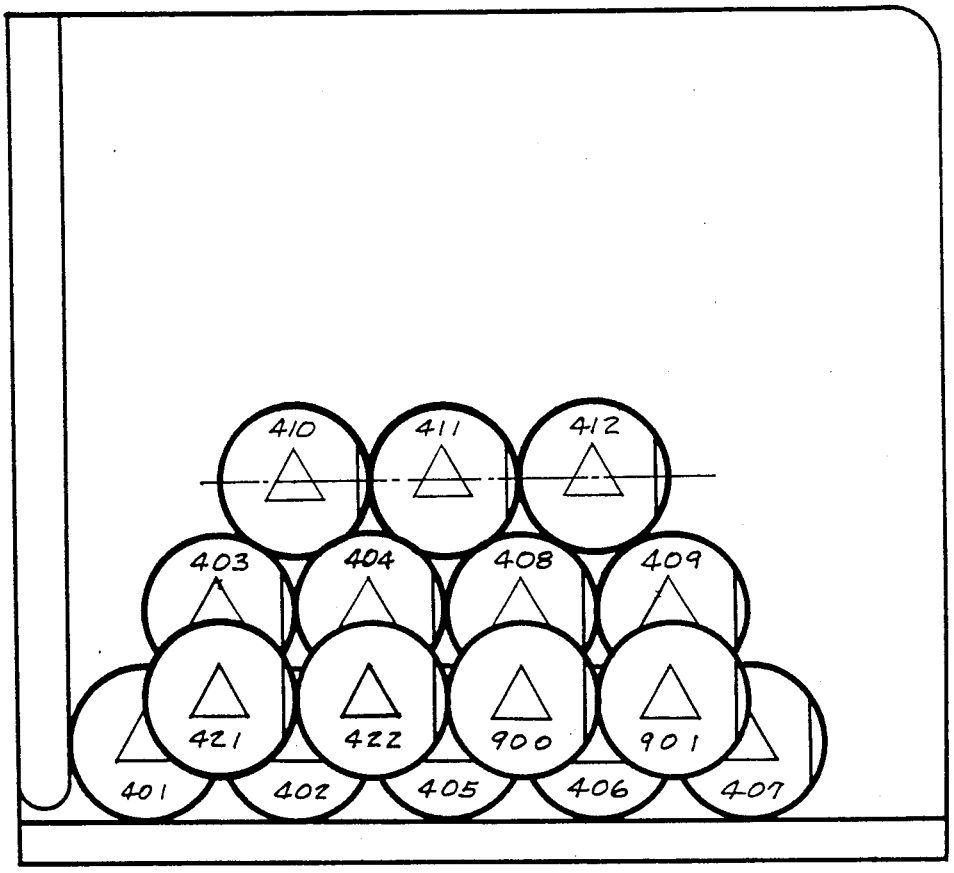
FIG. 4.3

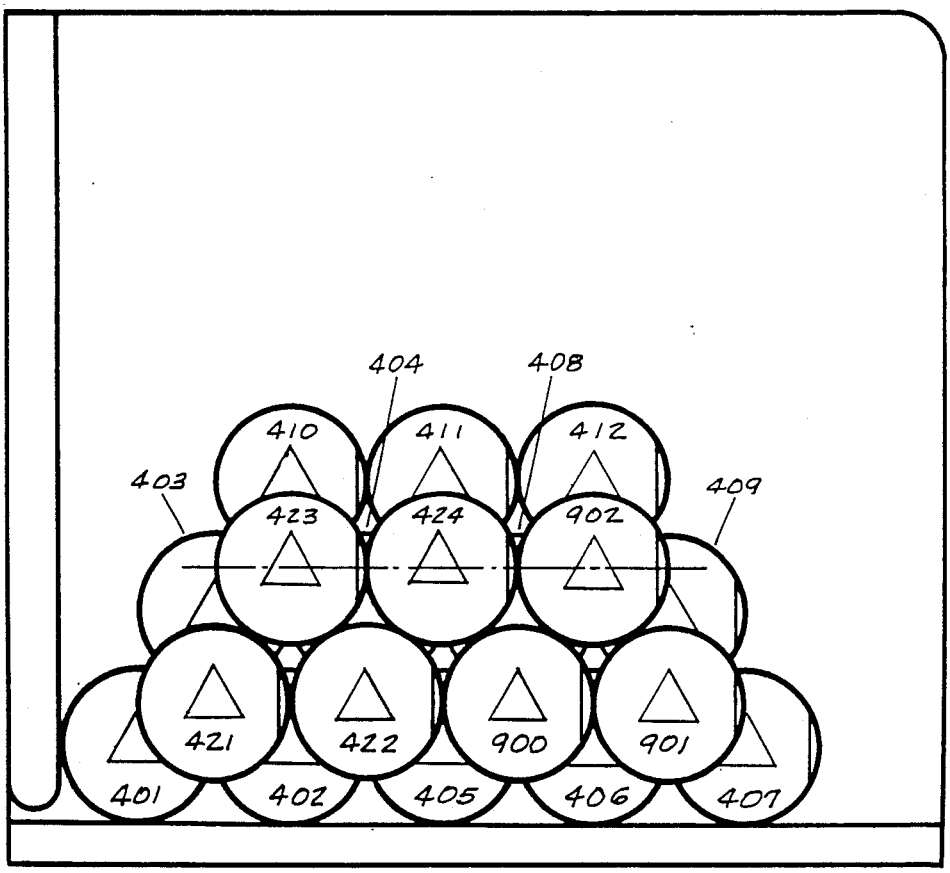
FIG. 4.4

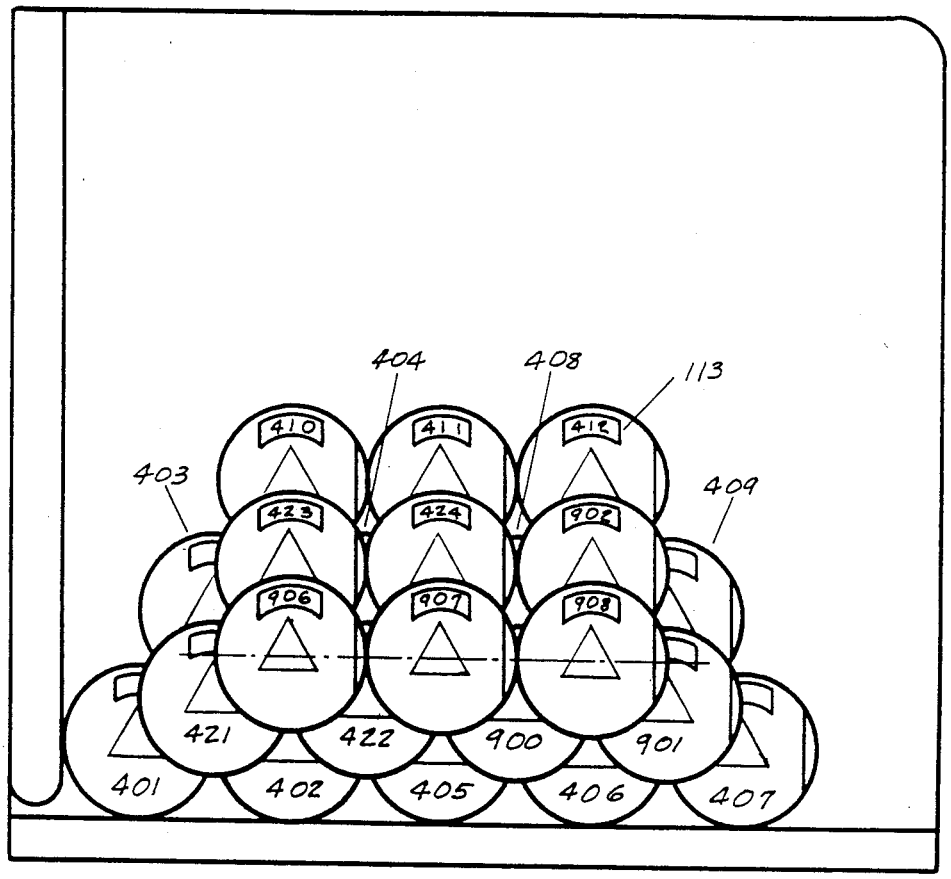
FIG. 4.5

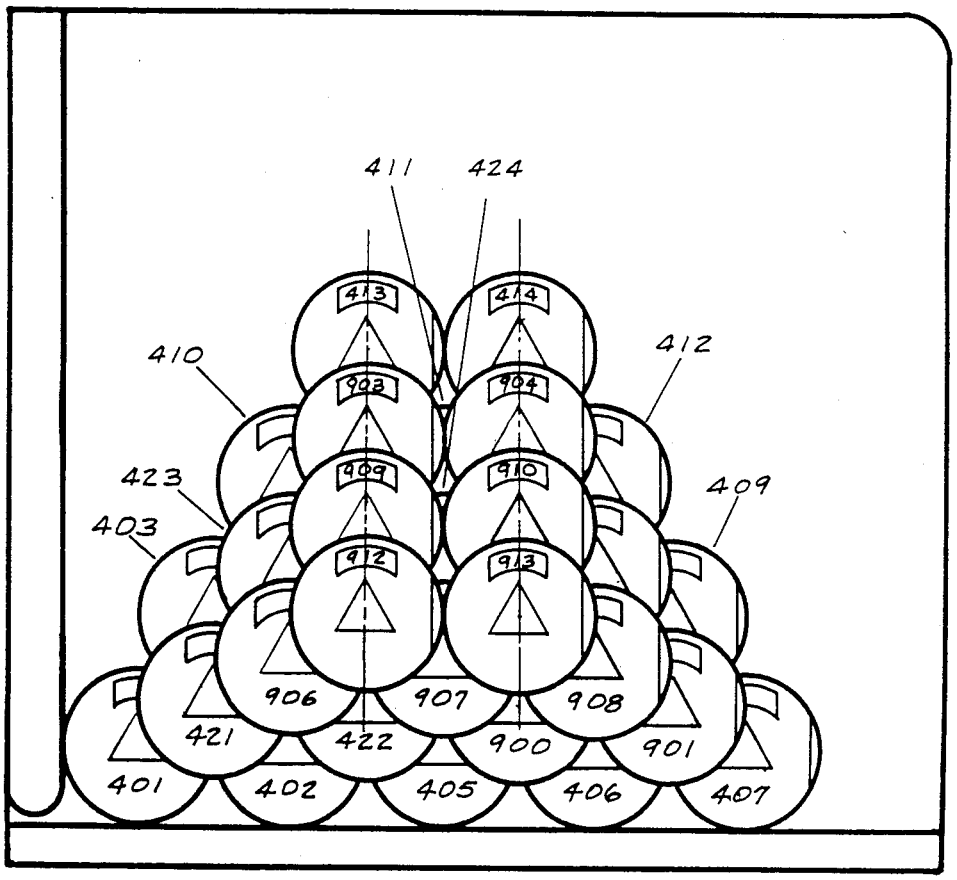
FIG. 4.6

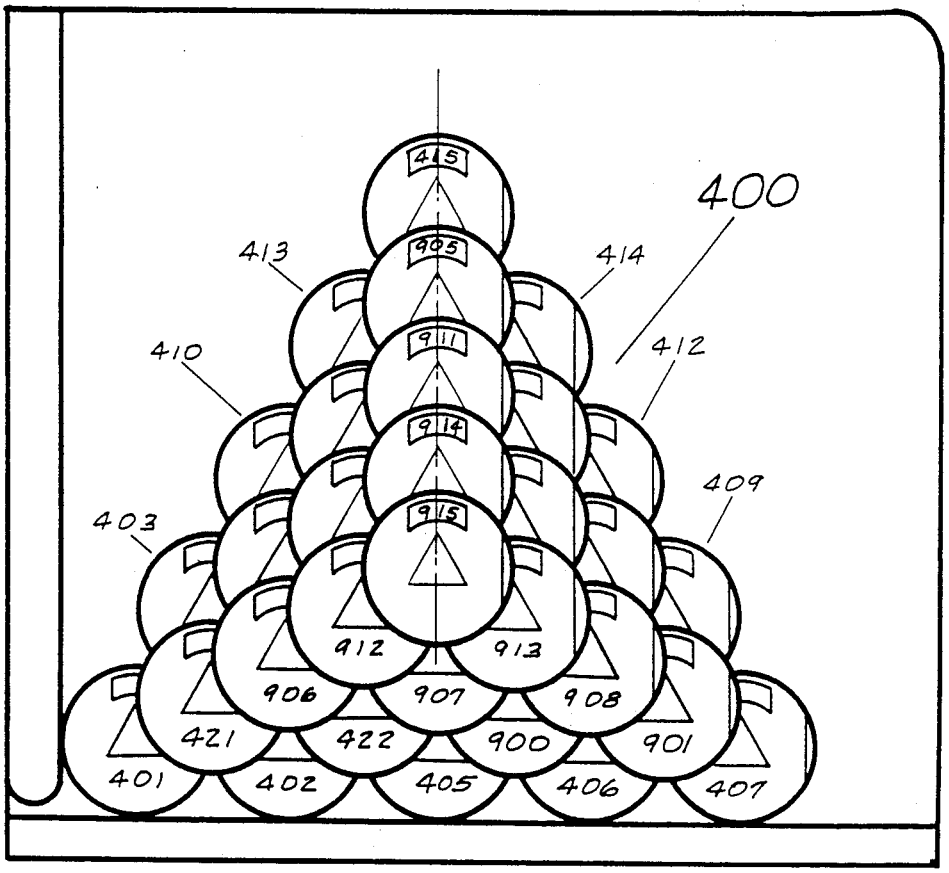
FIG. 4.7

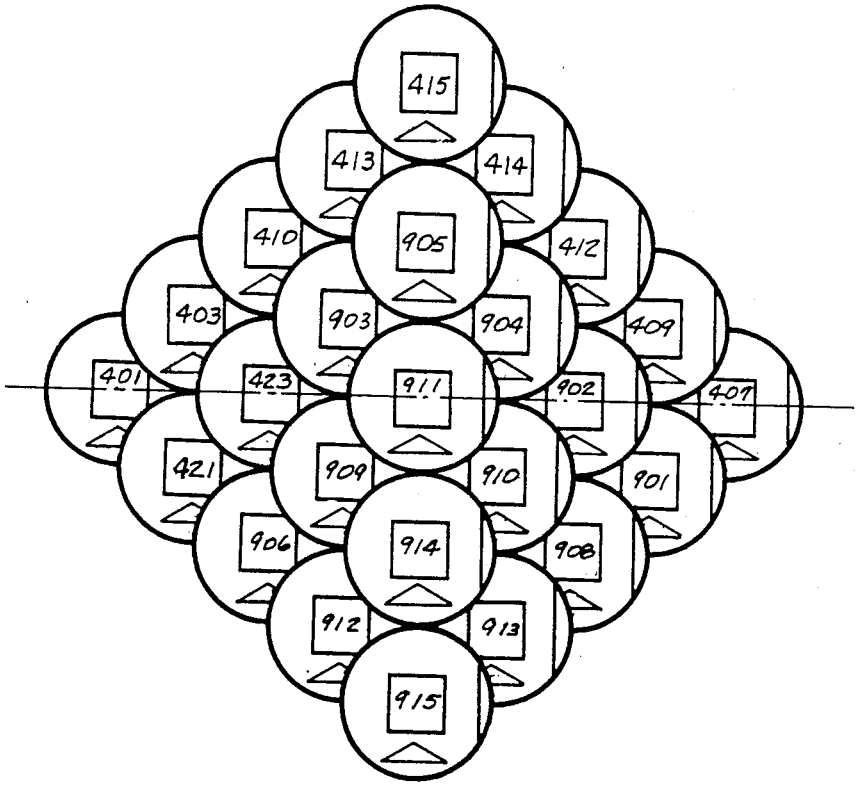
FIG. 4.8

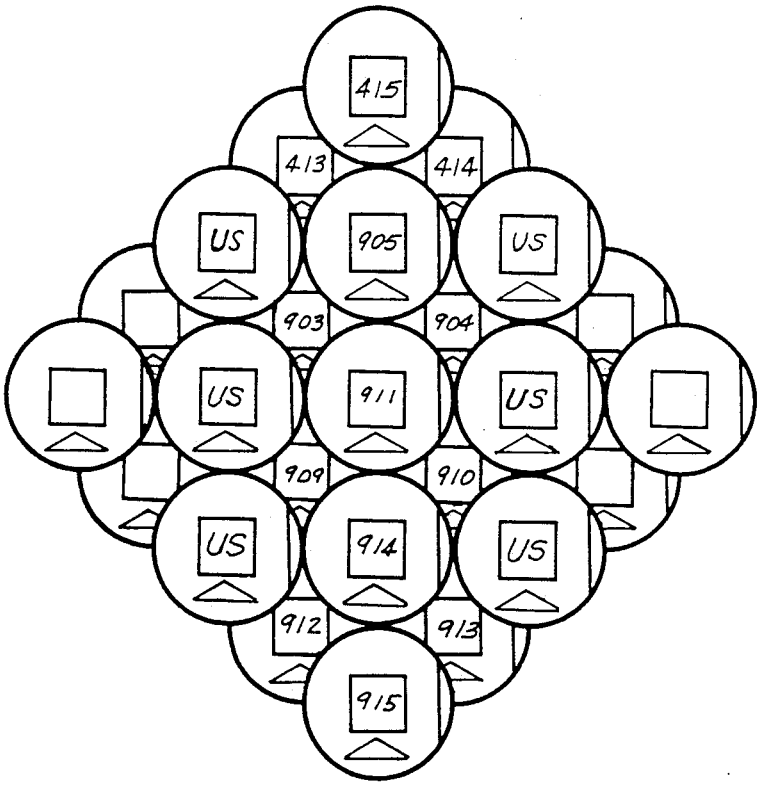
FIG. 4.9

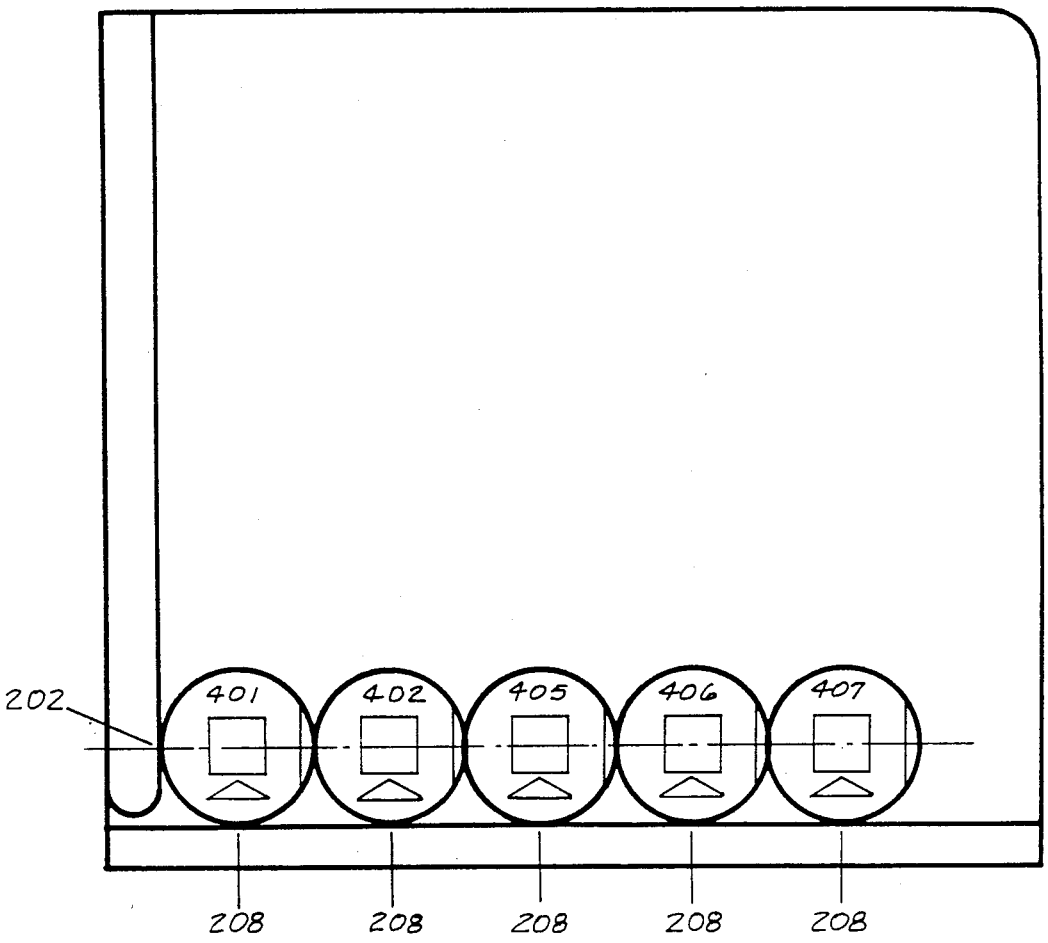
FIG. 5.0

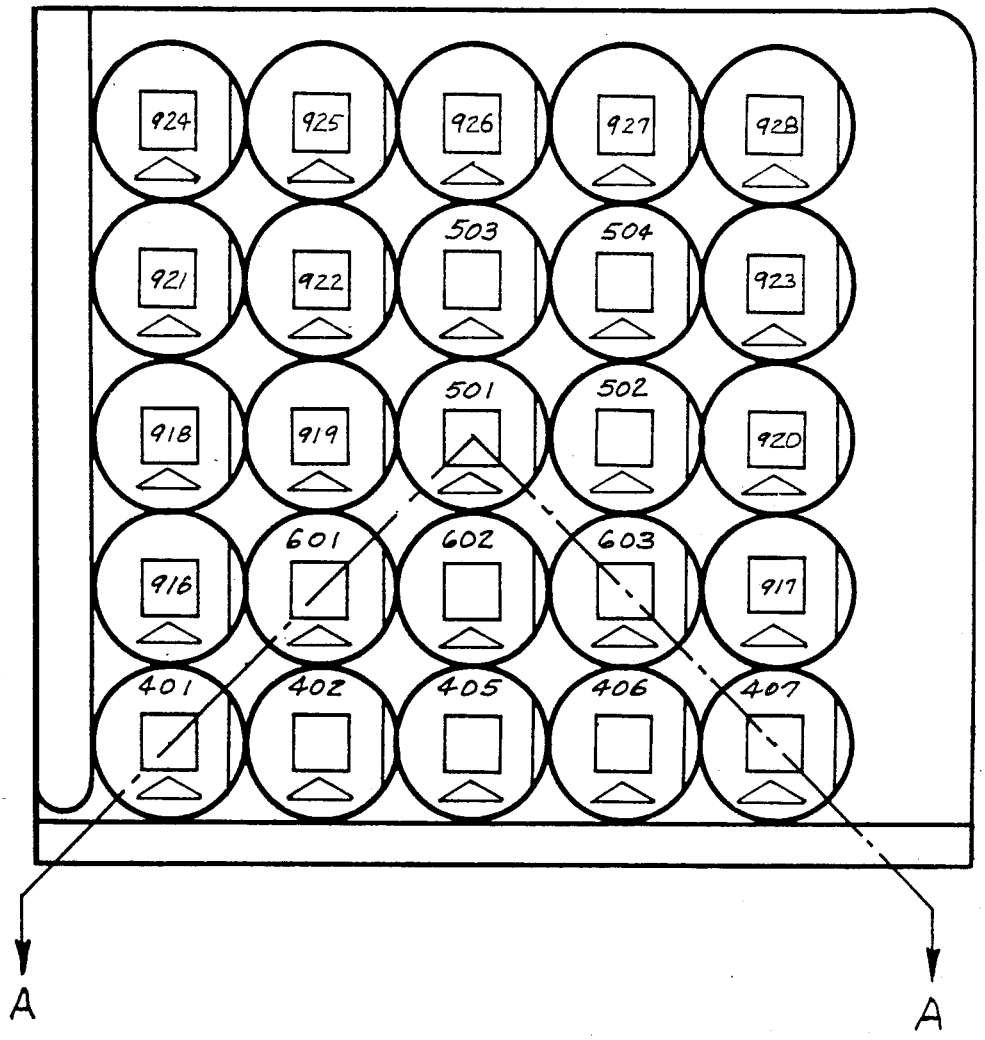
FIG. 5.1

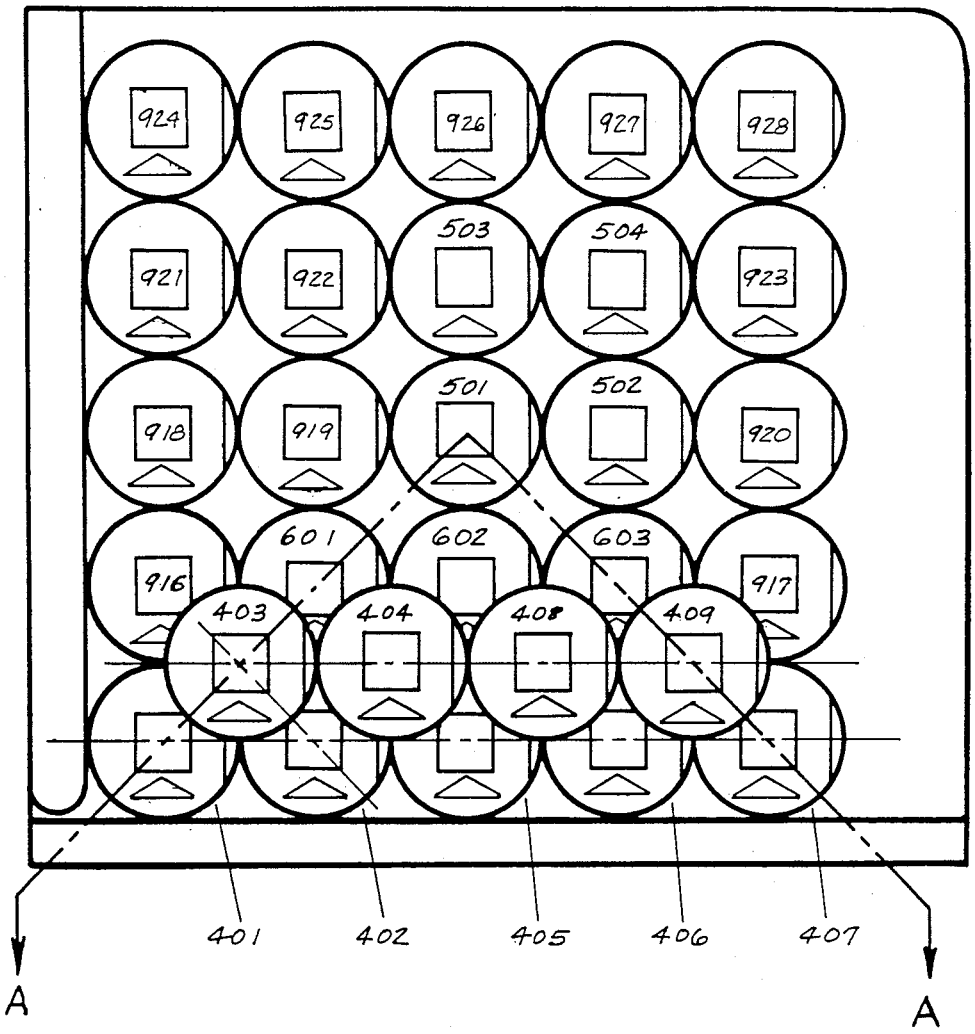
FIG. 5.2

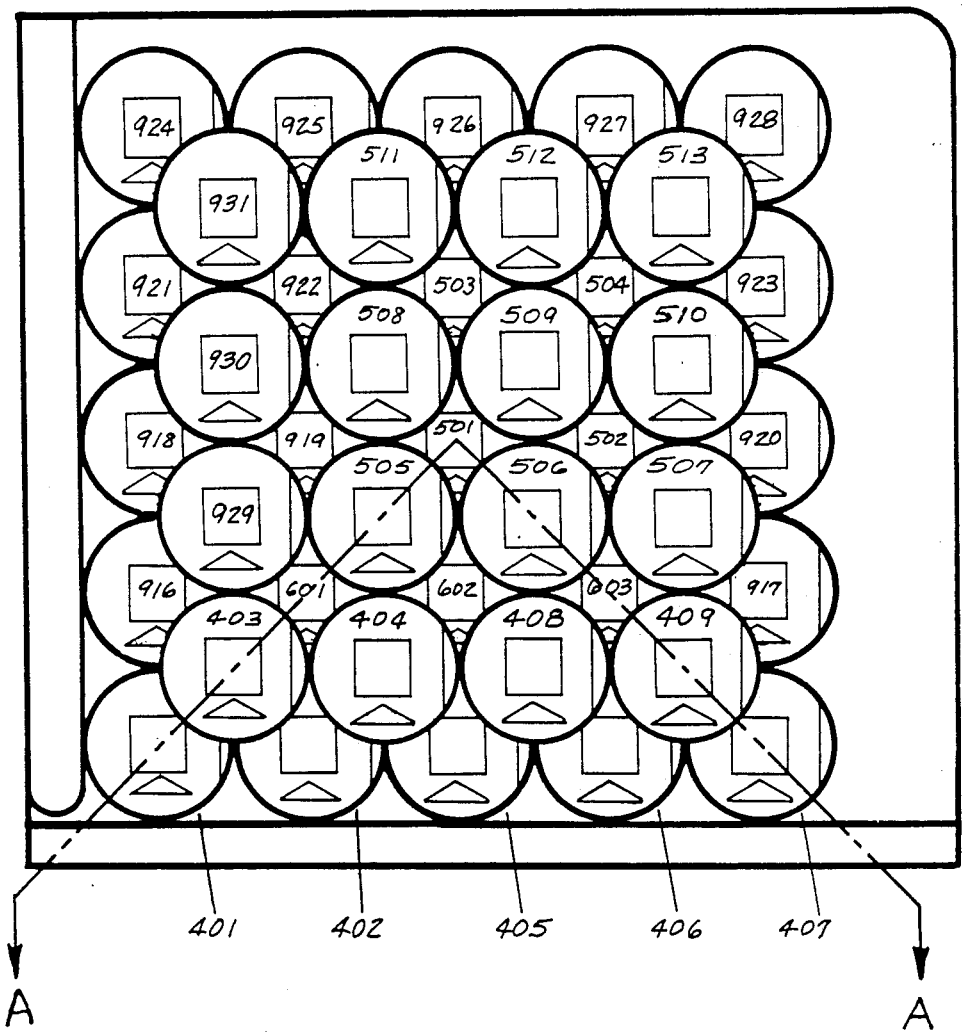
FIG. 5.3

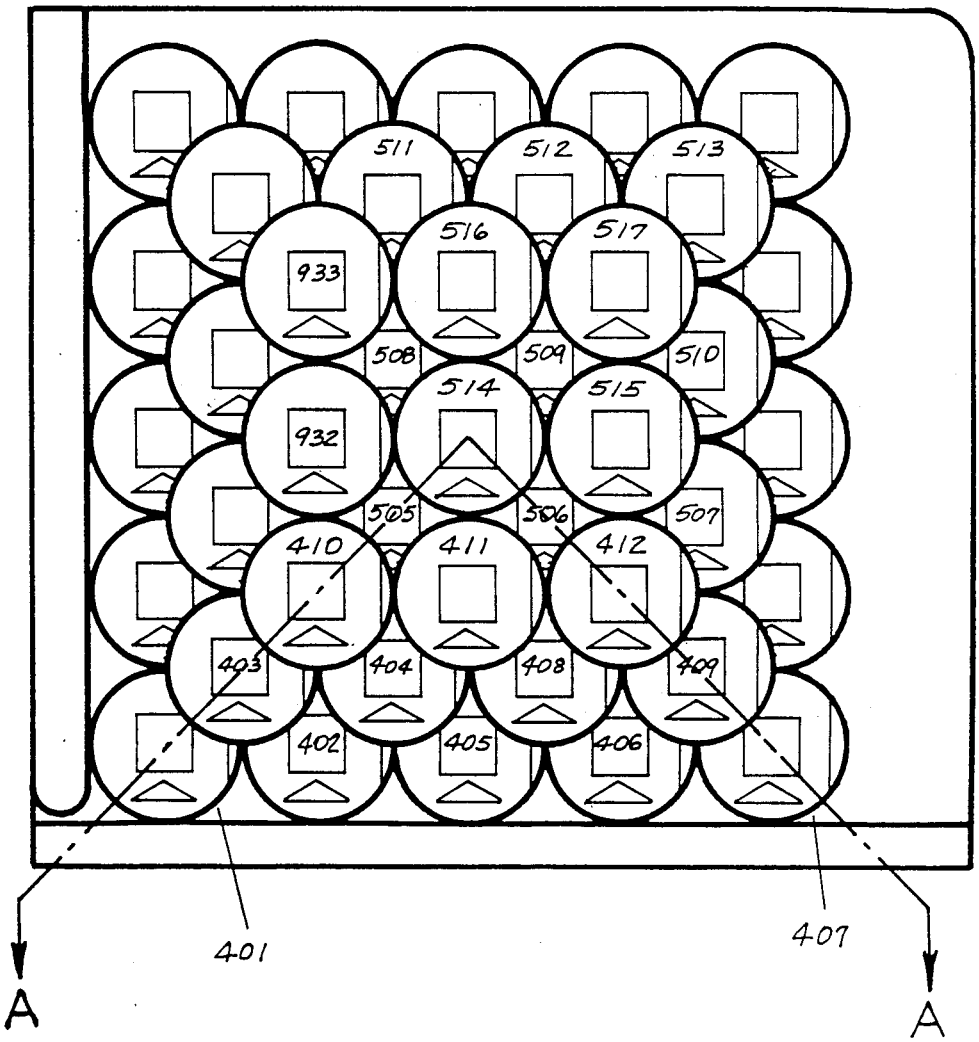
FIG. 5.4

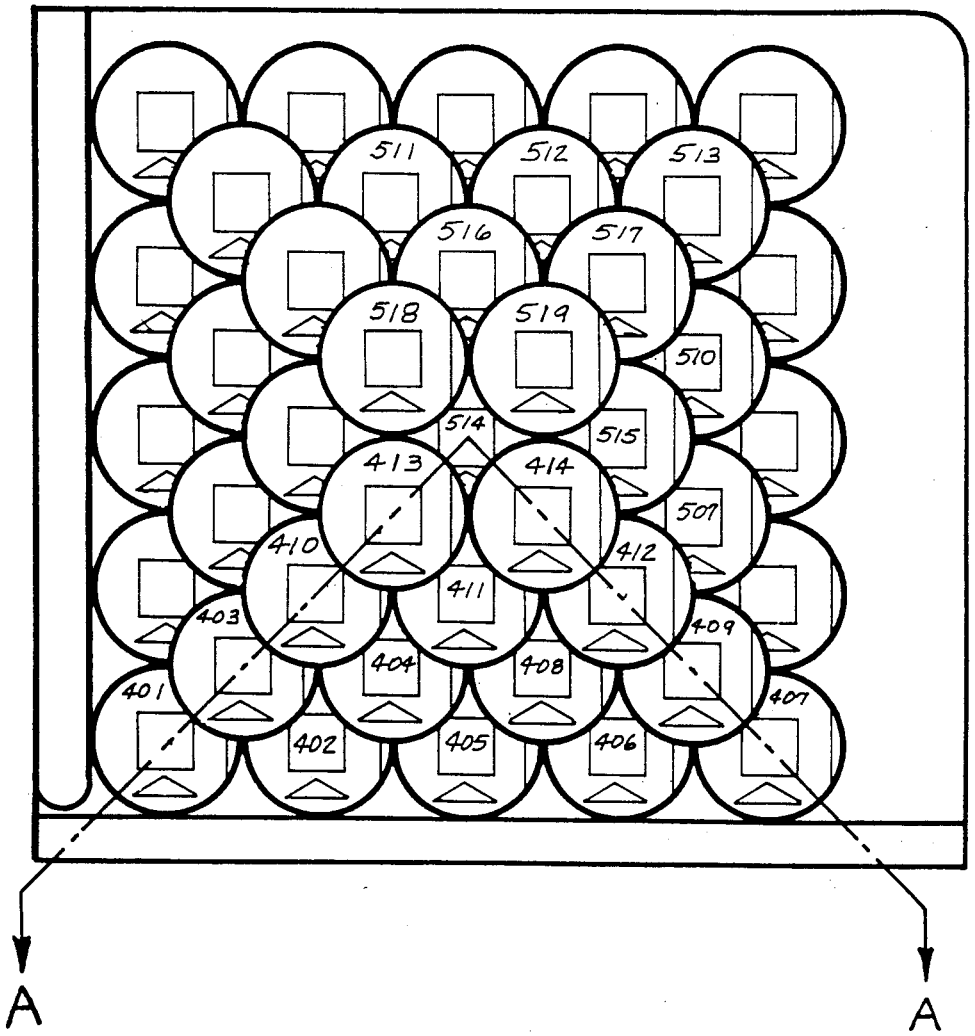
FIG. 5.5

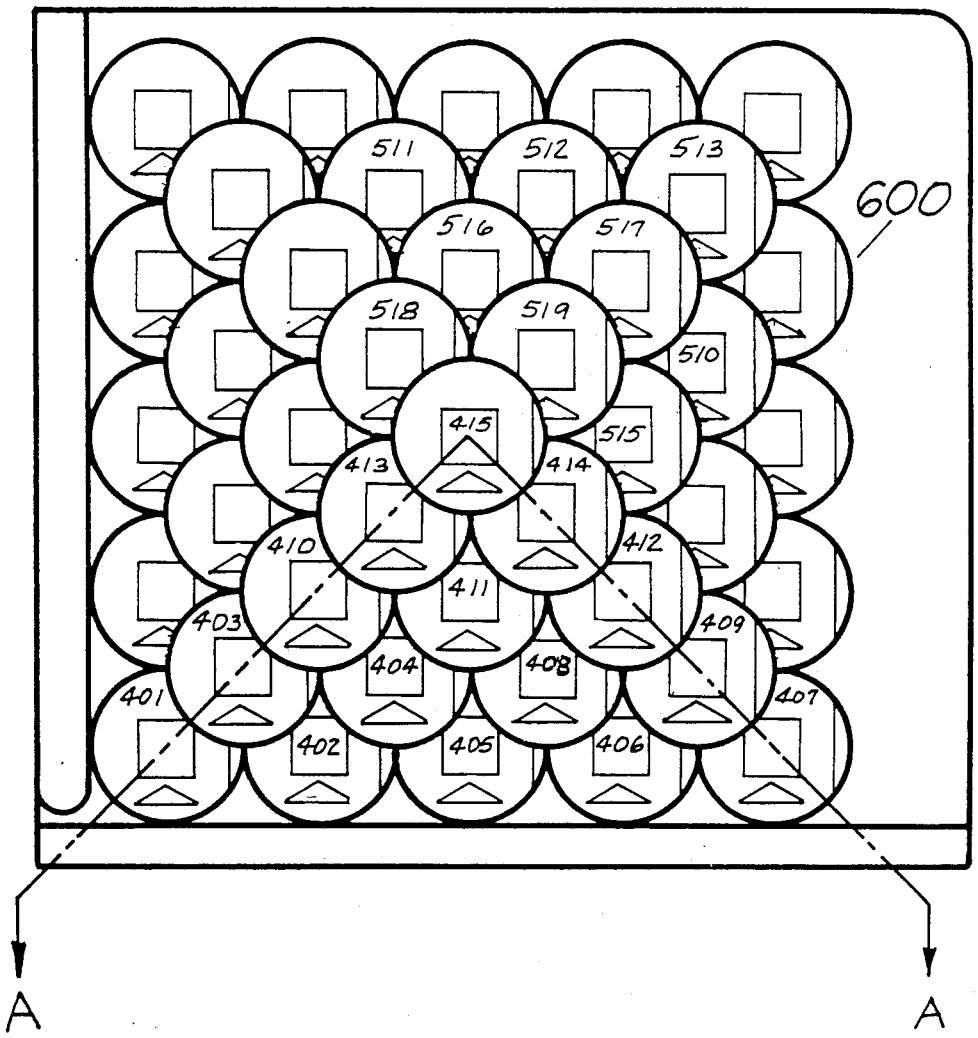
FIG. 5.6

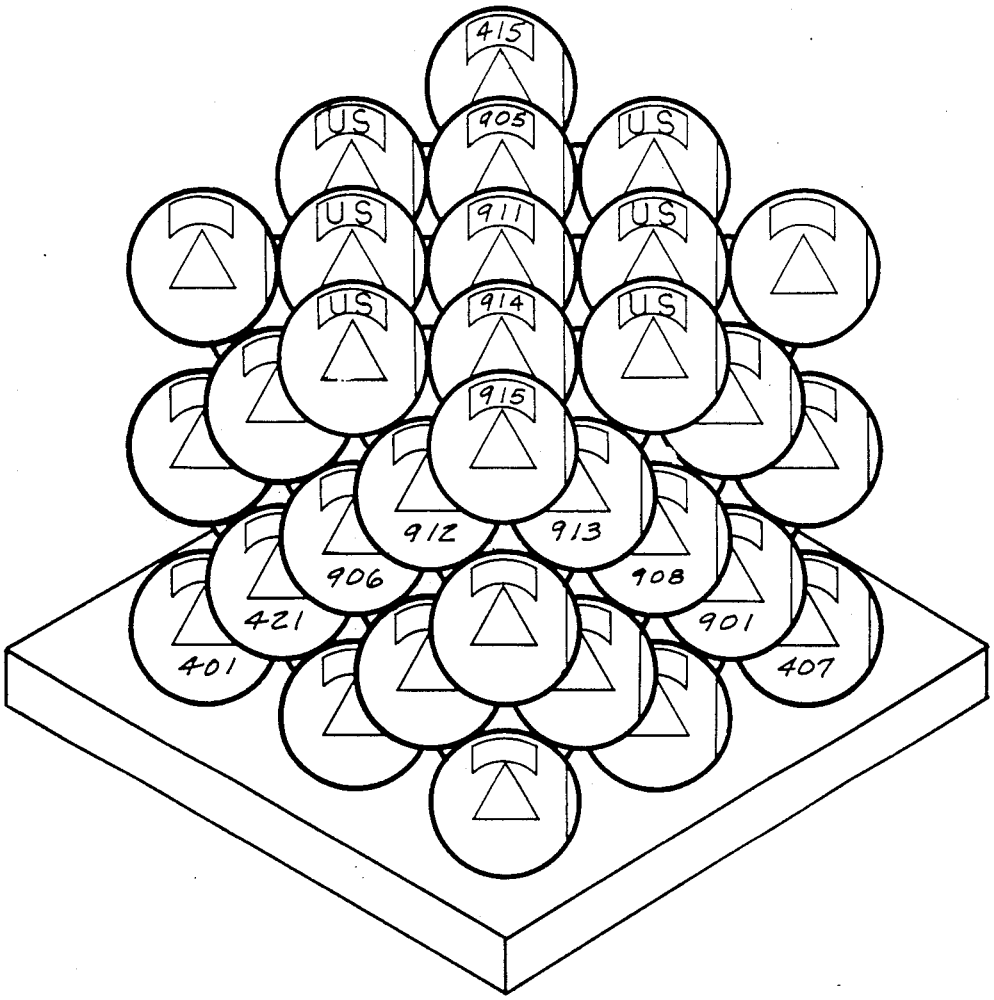
FIG. 6.0

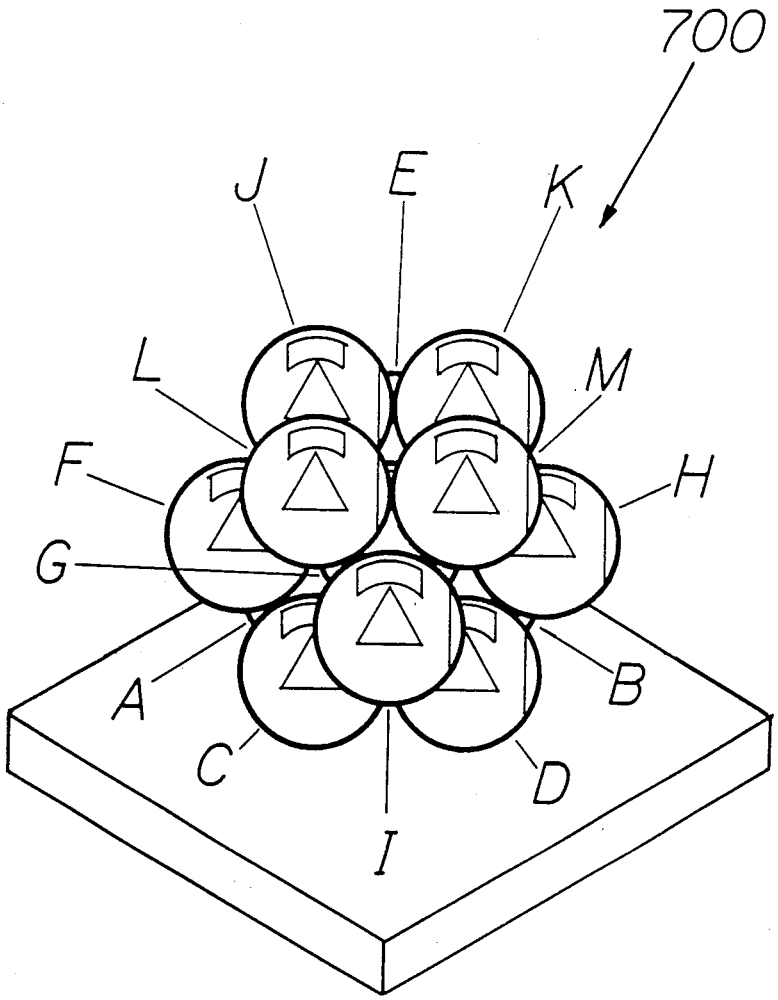
FIG. 6.1

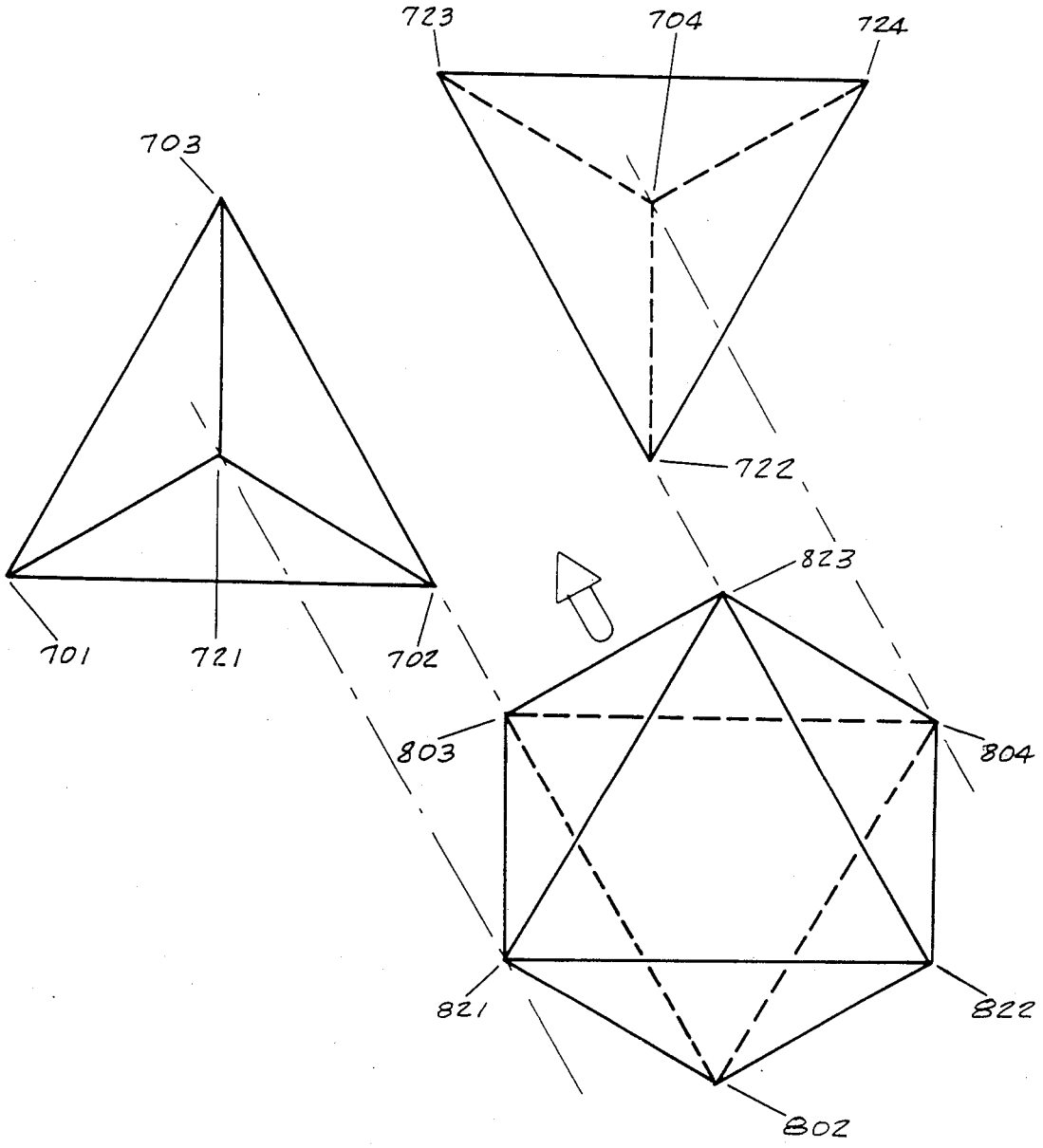
FIG. 7.0

EDUCATIONAL DEVICE AND METHOD

RELATED APPLICATIONS

This is a continuation in part application of Ser. No. 430,315, filed Sept. 30, 1982, now abandoned, of Ser. No. 430,316, filed Sept. 30, 1982, now U.S. Pat. No. 4,461,480 granted July 24, 1984, of Ser. No. 614,050, filed May 25, 1984, now abandoned, and of Ser. No. 628,209, filed July 5, 1984, now abandoned.

BACKGROUND OF THE INVENTION

In the past, ellipsoids with equal axes have been closely packed, under the force of gravity, into various structures. Critchlow in his book *Order in Space* (1970) illustrates ellipsoids with equal axes arranged in (a) a simple 4-ellipsoid with equal axes tetrahedral configuration, (b) a simple 6-ellipsoid with equal axes octahedral configuration, and (c) a simple 13-ellipsoid with equal axes cuboctahedral configuration, referring to each simple configuration as a distinct regular pattern. In discussing these arrangements, Critchlow indicates that the tetrahedral configuration is the most economic grouping of—ellipsoids of equal axes—while "the next most economic regular grouping of—ellipsoids of equal axes—is six in the octahedral configuration."

A preliminary examination of the ellipsoids of equal axes arranged in a tetrahedral configuration with a triangular base and in a 4-sided pyramid configuration with a square base would appear to support Critchlow's characterizations and distinctions. The lines connecting the centerpoints of the three ellipsoids of equal axes which form the "base" of the simple 4-ellipsoid tetrahedron form an equilateral triangle. On the other hand, the lines connecting the centerpoints of the four ellipsoids of equal axes which form the "base" of a simple 5-ellipsoid pyramid (i.e. a one-half octahedron) form a square.

In the past, a lattice structure based on a tetrahedral configuration and a lattice structure based on a pyramidal, or one-half octahedral configuration were viewed as different.

The fact that a tetrahedral configuration, an octahedral (or pyramidal) configuration and a cuboctahedral configuration yield precisely the same lattice structure when extended into space or merged together, however, has remained unknown and conspicuously unsuggested, especially as applied to ellipsoids of influence under the influence of gravity.

SUMMARY OF THE INVENTION

It is an object of the invention to demonstrate to a student that given a plurality of ellipsoids of influence closely packed under the following four conditions;

(a) ellipsoids of essentially equal size and shape;

(b) oriented with a similar bearing;

(c) stacked under the influence of gravity;

(d) with at least one common axis; then:

(I) the latticework structure started with four ellipsoids in a simple tetrahedral configuration; is equal to (II) the latticework structure started with five ellipsoids in a simple pyramidal or one-half octahedral configuration; is equal to (III) the latticework structure started with thirteen ellipsoids in a simple cuboctahedral configuration;

when these simple latticework structures of ellipsoids of influence are extended into space.

That is, notwithstanding the fact that the base of the simple tetrahedron latticework structure has a triangular base, the base of the simple octahedron latticework structure has a rectangular base (one-half octahedron), and the simple cuboctahedron latticework structure could be said to have both triangular bases and rectangular bases, the present invention demonstrates that, over space, ellipsoids of influence, arranged by starting in either of the three simple patterns, given the four conditions, closely pack in the same way.

Further, it is an object of the invention to show that a large tetrahedral configuration formed of, for example, ellipsoids, comprises the same internal latticework structure as a large pyramidal (one-half octahedron) configuration formed of the same ellipsoids, and that both of these configurations comprises the same internal latticework structure as a large cuboctahedral configuration formed of the same ellipsoids.

It is yet another object of the invention to demonstrate that in (a) a tetrahedral configuration having a base, or face, of fifteen ellipsoids (e.g. five ellipsoids along each edge) and (b) a pyramidal configuration having a base of twenty-five ellipsoids in a 5×5 arrangement, the same 13-ellipsoid cuboctahedral type of configuration is embodied in each. Moreover, in that the cuboctahedral type of configuration of closely packed ellipsoids is common to both the tetrahedral and octahedral configurations, a student will recognize the commonality of latticework structure of the three 'heretofore different' latticeworks, when these latticework structures are extended into space under the influence of gravity.

It is thus a further object of the invention to demonstrate the commonality of the closely packed tetrahedral, octahedral and cuboctahedral configurations of ellipsoids by selectively assembling or disassembling (a) a tetrahedral configuration of ellipsoids and (b) an octahedral configuration of ellipsoids with an intact cuboctahedral type of configuration of closely packed ellipsoids contained therein.

Furthermore, it is an object of the invention to show that the tetrahedral configuration closely packed and expanded into space under the aforementioned four conditions define imaginary thirteen nonparallel planes.

Still further, where a latticework is defined by spacepoints that are determined by the centerpoints of ellipsoids or other corresponding structural members representing fields of influence that are closely packed under the aforementioned four conditions, then the relative dimensions of the major and minor axes of the ellipsoid when the common axis and the location of either orientation mark are known, uniquely deterine the relative distances or lengths between the spacepoints in the corresponding latticework structure.

Conversely, the relative distances or lengths between the four corners of a corresponding tetrahedron, when the edge that is equal to the common axis is known, uniquely determine the major and minor axes and the location of both orientation marks of the corresponding ellipsoid or ellipsoidal field of influence that creates the corresponding latticework structure and uniquely determine the relative distances or lengths between, and orientation of, the six corners of the corresponding octahedron and uniquely determine the relative distances or lengths between, and orientation of, the four corners of the other inverted corresponding tetrahedron.

Further still, when the common axis and the location of either orientation mark are known, the lengths of the major and minor axes of the corresponding ellipsoid or ellipsoidal field of influence, uniquely define imaginary thirteen nonparallel planes in the corresponding latticework structure when the corresponding ellipsoids are gravity stacked under the aforementioned four conditions.

A further object of the invention is to demonstrate that eight ellipsoids closely packed under the aforementioned four conditions uniquely define two corresponding tetrahedrons plus their corresponding octahedron;

this invention thus demonstrates that two corresponding tetrahedrons plus their corresponding octahedron equal one corresponding rhombohedron;

and it is further shown that each corresponding rhombohedron is equal in volume to six corresponding tetrahedrons;

further still, it is shown that each corresponding octahedron is equal in volume to four corresponding tetrahedrons;

it further demonstrates that the total solid angles of the eight corners of two corresponding tetrahedrons plus the solid angles of the six corners of their corresponding octahedron equal the total solid angle in the centerpoint of one corresponding ellipsoid;

still further, it is shown that there is one general common imaginary thirteen nonparallel plane space latticework that closely packed ellipsoids of influence assume when the aforementioned four conditions are satisfied, where the ellipsoid of influence can be imagined to be in a plurality of ellipsoids in the form of;

(A) a crystal or solid;

(B) a liquid;

(C) a gas; or (D) very regular spirals helical like of ellipsoids in a radio wave or some other electromagnetic spectrum wave.

Methods that achieve these objects are exemplified by the following methods.

A method teaching the characteristics of corresponding latticework structure comprises the steps of demonstrating the commonality of lattice structure of (a) latticework arranged in accordance with a tetrahedral configuration and (b) latticework arranged in accordance with a pyramidal configuration (one-half octahedron) which has (i) a four-edge base and (ii) four faces that extend from the base and meet at a point, the demonstrating step including the steps of: positioning a plurality of structural members relative to each other to define spacepoints in a latticework arranged in accordance with the tetrahedral configuration; positioning a plurality of structural members relative to each other to define spacepoints in a latticework arranged in accordance with the pyramidal configuration; wherein the positioning steps include merging together structural members along at least one face of the latticework arranged in accordance with the tetrahedral configuration with structural members along at least one corresponding face of the latticework arranged in accordance with the pyramidal configuration to make the spacepoints along at least one tetrahedral face coexistent with the spacepoints on at least one corresponding pyramidal face. Each positioning step includes the step of gravity stacking a plurality of at least substantially similarly dimensioned similarly oriented ellipsoidal elements, wherein each ellipsoidal element is one of the structural members and the centerpoint of each ellipsoidal element is a spacepoint in the latticework.

The educational toy of the invention is exemplified by a toy for teaching characteristics of latticework structure comprising; a plurality of similarly dimensioned ellipsoidal elements, each ellipsoidal element being dimensionally characterized by a major axis and two minor axes where the axes are orthogonal and are axes of symmetry;

and each ellipsoidal element being characterized by having one end of the common axis marked with a circle or other indicia to indicate the orientation of the common axis;

and each ellipsoidal element being characterized by a common axis connector hole passing through the centerpoint of this common axis orientation mark and the centerpoint of the ellipsoidal element and through the ellipsoidal element and thus uniquely defining the common axis of the ellipsoidal element;

and each ellipsoidal element being characterized by a triangular orientation mark or indicia on the surface of the ellipsoidal element locating the up direction when a first ellipsoidal element is gravity stacked on the gravity tray starting in the tetrahedral configuration;

and each ellipsoidal element being characterized by optionally being capable of being connected to a second ellipsoidal element along their common axis connector holes when both ellipsoidal elements have been gravity stacked on the gravity tray and oriented so that their orientation marks all point the same way with the common axis orientation mark pointing away from the lowest corner of the gravity tray, without being moved from their gravity stacked positions by using a special connecting tool and special torsion spring friction coupling;

and each ellipsoidal element being characterized by a second connector hole such that when a third ellipsoidal element is gravity stacked against first and second ellipsoidal elements that have optionally been connected along their common axis connector holes, and all orientation marks on the three ellipsoidal elements are correctly oriented in the same direction, and said third ellipsoidal element is gravity stacked so that it touches the first ellipsoidal element at one point and the second ellipsoidal element at one point and the gravity tray at one point, the centerline of the aforementioned second connector hole passes through the centerpoint of the third ellipsoidal element and the centerpoint of the first ellipsoidal element, thus enabling the third ellipsoidal element to optionally be connected to the first ellipsoidal element using their second connector holes and the aforementioned special torsion spring friction coupler;

and each ellipsoidal element being characterized by a third connector hole such that when a third ellipsoidal element is optionally connected to a first ellipsoidal element along their second connector holes, and the first ellipsoidal element is optionally connected to a second ellipsoidal element along their common axis connector holes on the gravity tray as aforementioned, the centerline of the third connector holes passes through the centerpoints of the third ellipsoidal element and the second ellipsoidal element in such a manner that the third ellipsoidal element optionally may be connected to the second ellipsoidal element using their third connector holes and aforementioned torsion spring friction device;

and each ellipsoidal element being characterized by a fourth connector hole such that when a fourth ellipsoidal element is gravity stacked on top of optionally connected first three ellipsoidal elements, with its common axis orientation mark in the same direction as the common axis orientation marks of the first three ellipsoidal elements, with all triangular orientation marks in the up position, the centerline of the fourth connector hole passes through the centerpoints of the fourth ellipsoidal element and the third ellipsoidal element in such a manner that the fourth ellipsoidal element optionally may be connected to the third ellipsoidal element using their fourth connector holes and aforementioned torsion spring friction device;

and each ellipsoidal element being characterized by a fifth connector hole such that when a fourth ellipsoidal element is gravity stacked on top of optionally connected first three ellipsoidal elements, with its common axis orientation mark in the same direction as the common axis orientation marks of the first three ellipsoidal elements, with all triangular orientation marks in the up position, the centerline of the fifth connector hole passes through the centerpoints of the fourth ellipsoidal element and the first ellipsoidal element in such a manner that the fourth ellipsoidal element optionally may be connected to the first ellipsoidal element using their fifth connector holes and aforementioned torsion spring friction device;

and each ellipsoidal element being characterized by a sixth connector hole such that when a fourth ellipsoidal element is gravity stacked on top of optionally connected first three ellipsoidal elements, with its common axis orientation mark in the same direction as common axis orientation marks of the first three ellipsoidal elements, with all triangular orientation marks in the up position, the centerline of the sixth connector hole passes through the centerpoints of the fourth ellipsoidal element and the second ellipsoidal element in such a manner that the fourth ellipsoidal element optionally may be connected to the second ellipsoidal element using their sixth connector holes and aforementioned torsion spring friction device;

and each ellipsoidal element being characterized by a rectangular orientation mark or square mark or indicia indicating the up position of the ellipsoidal element when gravity stacked in the pyramidal or one-half octahedral configuration by optionally connecting the common axis connecting holes of the first and second ellipsoidal elements after being gravity stacked on the gravity tray, and further optionally connecting the common axis connecting holes of the third and fourth ellipsoidal elements that have also been gravity stacked on the gravity tray, and further optionally connecting the fourth connecting holes of the first and third ellipsoidal elements after rotating their triangular orientation marks toward the front wall of the gravity tray so that their rectangular orientation marks are in the up position, and further optionally connecting the fourth connecting holes of the second and fourth ellipsoidal elements after rotating their triangular orientation marks toward the front wall of the gravity tray so that their rectangular orientation marks are in the up position;

and each ellipsoidal element being characterized by being able to be optionally connected to the first four ellipsoidal elements that have been correctly gravity stacked on the gravity tray in the rectangular or pyramidal configuration, by being considered the fifth ellipsoidal element and being correctly oriented and gravity stacked on top of the first four ellipsoidal elements, so that the second connecting holes of the fifth and first ellipsoidal elements are in alignment, the third connecting holes of the fifth and second ellipsoidal elements are in alignment, the fifth connecting holes of the fifth and third ellipsoidal elements are in alignment and the sixth connecting holes of the fifth and fourth ellipsoidal elements are in alignment, thus allowing optional connection of the fifth ellipsoidal element to any or all of the first four ellipsoidal elements without moving any of the ellipsoidal elements from their gravity stacked positions on the gravity tray.

Thus the plurality of ellipsoids have six unique connector holes similarly located through their centerpoints and have similarly located common axis orientation marks, similarly located triangular or tetrahedron orientation up marks and similarly located rectangular orientation or square pyramidal up marks, where the six connector holes are made in such a manner that the ellipsoidal elements optionally may be connected without disturbing the gravity stacked position of the ellipsoidal elements on the gravity tray when the ellipsoidal elements are gravity stacked properly in either the tetrahedral configuration or the pyramidal (one-half octahedron) configuration.

Alternately the unique connector hole endpoints may be velcro or magnetic elements that have a polarity effect to them as it is seen that the unique connector holes are effectively polarized. For example, it is necessary to have opposite endpoints of the same connector hole touching each other before even the same unique connector holes can be correctly optionally connected. Another method to connect the gravity stacked ellipsoidal elements uses multiple suction cups made of soft rubber or other flexible material on each side of an effective zero length coupling device that optionally can be placed at the contact points as the elements are being gravity stacked.

Table I gives four different types of ellipsoids sets in Sections (a) through (d). It is logical to dimension the ellipsoid sets and their corresponding tetrahedron and octahedron block sets using a method that give similar ratios for similar distances if such a method exists. One such method is to define the center-to-center distance between the first four ellipsoids that can be gravity stacked on the tray in the simple tetrahedron configuration. In FIG. 4.2, the said four ellipsoids are 401, 8402, 403 and 421. Then use these same center-to-center distances as the corner-to-corner distances between the spacepoints of the corresponding tetrahedrons and octahedrons as shown in FIG. 7.0. This causes the distances between spacepoints 701 and 702 to be the same as the distances between centerpoints 401 and 402; between spacepoints 702 and 703 to be the same as between centerpoints 402 and 403; between spacepoints 703 and 701 to be the same as between centerpoints 403 and 401; between spacepoints 721 and 701 to be the same as between centerpoints 421 and 401; between spacepoints 721 and 702 to be the same as between centerpoints 421 and 402; and between spacepoints 721 and 703 to be the same as between centerpoints 421 and 403. This method of dimensioning enables the exact same ratios of distances to be used in Table I Sections (a) through (d) for center-to-center distances for ellipsoids 401, 402, 403 and 421, and in Table II Sections (a) through (d) for corner-to-corner distances for spacepoints 701, 702, 703 and 721 for the corresponding matching 'up' tetrahedron and the corresponding spacepoints for the matching 'down' tetrahedron and the corresponding spacepoints for the matching octahedron as shown in FIG. 7.0.

It is not necessarily intuitively clear that these six distances uniquely define the space latticework of a plurality of ellipsoids of influence closely packed under the aforementioned four conditions and this is part of the subject matter of the present invention.

In Table I Sections (a), (b), (c) and (d), the common axis of the ellipsoidal element is defined by the centerpoints of ellipsoids 401 and 402 as indicated by the common axis circle marks to the righthand end of the said ellipsoids. The length of the first axis of the ellipsoid is equal to the distance between the centerpoints of ellipsoids 401 and 402. For example, one-half of the first axis is from centerpoint of 401 to the point of contact with 402, plus the other one-half of the first axis is from said point of contact to the centerpoint of 402.

In all four Sections of Tables I and II, for a given set of ellipsoids or their matching corresponding tetrahedron and octahedron set of blocks, the distance between the centerpoints of ellipsoids on the common axis has arbitrarily been assigned the unit distance 'D', so that the other center-to-center distances and other corner-to-corner spacepoint distances may be defined as a ratio of the common axis length unit distance 'D'.

In Table I Section (a) all six center-to-center distances are equal to the unit distance 'D'. The length of the first axis of the ellipsoid, as stated above, is equal to the center-to-center distance of ellipsoids 401 and 402. The student sees by examining FIG. 5.2 that ellipsoid 421 of FIG. 4.2 closely packs against 401, 402 and 403 in such a manner that the center line between 421 and 403 is always parallel to the gravity tray in the rectangular orientation and is always at right angles to the common axis 401 and 402. Thus, in Table I Section (a), all of the ellipsoids have to be ellipsoids of rotation about a third axis that is vertical to the gravity tray in the rectangular configuration. The vertical view of the ellipsoid set in Table I Section (a) in the rectangular configuration are circles and look just like FIG. 5.2. The length of the second axis is equal to the length of the first axis and is equal to the distance between ellipsoids 421 and 403 in the ellipsoid set in Table I Section (a).

In Table I Section (a), the third axis of the ellipsoid has to be perpendicular to the plane of the first and second axes, but may be any length desired. This enables the student to calculate the length of the third axis to obtain the desired center-to-center distance of the four remaining equal center-to-center distances which desired distance is set forth in Table I Section (a) as a ratio of the unit distance 'D'. In this case, the remaining four center-to-center distances are equal to the unit distance 'D'. This, of course, is the special case where the ellipsoid is a sphere.

In Table I Section (b) the center-to-center distance of ellipsoids 401 and 402 is equal to unit distance 'D' and as aforementioned this is the length of the first axis of the ellipsoid., The student sees by examining FIG. 5.2 that ellipsoid 421 of FIG. 4.2 closely packs against 401, 402 and 403 in such a manner that the center line between the centerpoints of 421 and 403 is always parallel to the gravity tray in the rectangular orientation and is always at right angles to the first common axis 401 and 402. Therefore the length of the second axis is equal to the distance between the centerpoints of 421 and 403 and from Table I Section (b) is also equal to the unit distance 'D'.

Thus, in Table I Section (b), all of the sets of ellipsoids have to be ellipsoids of rotation about the third axis that is vertical to the gravity tray in the rectangular configuration. Therefore the vertical view of the ellipsoid sets in Table I Section (b) in the rectangular configuration are circles and look just like FIG. 5.2.

Therefore for the ellipsoid sets in Table I Section (b), the third axis of the ellipsoid is perpendicular to the plane of the first and second axes, just as the definition of an ellipsoid requires, but this third axis may be any length desired and still be an ellipsoid of revolution. This enables the student to adjust the length of the third axis of each set of ellipsoids to obtain the desired center-to-center distance of the remaining four equal center-to-center distances as set forth as a ratio of the unit distance 'D', in Table I Section (b).

In Table I Section (c) the center-to-center distance of ellipsoids 401 and 402 is equal to unit distance 'D' and as aforementioned this is the length of the first axis of the ellipsoid. Also, the center-to-center distances of ellipsoids 402 and 403, and 403 and 401 are all equal to unit distance 'D'. Therefore, in the triangular configuration, the centerpoints of these three ellipsoids make an equilateral triangle. The ellipsoid sets that make this center-to-center pattern have to be sets of ellipsoids of revolution where the third axis is the axis of rotation and is perpendicular to the gravity tray in the triangular or tetrahedron configuration.

In Table I Section (c), the length of the second axis of the ellipsoid is equal to the distance between ellipsoids 401 and 402, as these sets of ellipsoids are ellipsoids of revolution about the third axis perpendicular to the gravity tray in the tetrahedron configuration. Therefore the second axis is equal to the unit distance 'D', and is at right angles to the common axis and in the plane of the gravity tray when the ellipsoidal element is in the tetrahedron configuration. The vertical view of these sets of ellipsoids then look just like FIG. 4.2 as their cross-section are circles in the tetrahedron configuration.

Therefore for the ellipsoid sets in Table I Section (c), the third axis of the ellipsoid is perpendicular to the plane of the first and second axes, just as the definition of an ellipsoid requires, but this third axis may be any length desired and still be an ellipsoid of revolution. This enables the student to adjust the length of the third axis of each set of ellipsoids to obtain the desired center-to-center distance of the remaining three equal center-to-center distances as set forth as a ratio of the unit distance 'D', in Table I Section (c).

In Table I Section (d) the center-to-center distance of the common axis ellipsoids 401 and 402 is equal to the length of the first axis of the ellipsoid, and is also equal to unit distance 'D'. The student sees by examining FIG. 5.2 that ellipsoid 421 of FIG. 4.2 closely packs against 401, 402 and 403 in such a manner that the center line between 421 and 403 is always parallel to the gravity tray in the rectangular orientation and is always at right angles to the common first axis 401 and 402. Therefore the length of the second axis is equal to center-to-center distance of ellipsoids 421 and 403.

However, in Table I Section (d), the center-to-center distance between ellipsoids 421 and 403 is not equal to the center-to-center distance between ellipsoids 401 and 402. Thus, in Table I Section (d), we have unique sets of general ellipsoids that are not ellipsoids of rotation.

Thus, the sets of ellipsoids in Table I Section (d), have first and second axes that are at right angles to each other in the rectangular configuration. Therefore, the third axis of these sets of ellipsoids has to be vertical to the plane of the gravity tray when the ellipsoidal element is in the rectangular configuration, and can be any length desired. As set forth in Table I Section (d), the length of the first axis of each set of ellipsoids is equal to the center-to-center distance between ellipsoids 401 and 402 and is equal to unit distance 'D', and the length of the second axis is equal to the center-to-center distance between ellipsoids 421 and 403 and given as a ratio of unit distance 'D'. The length of the first axis and the length of the second axis uniquely define the ellipse made by passing a plane through the centerpoint of the ellipsoid that is also parallel to the gravity tray in the rectangular or octahedral configuration. This enables the student to determine the length of one axis of a vertical ellipse made by passing a plane through the centerpoints of ellipsoids 401, 403 and 601 in FIG. 5.2. The second axis of this vertical ellipse is also equal to the third axis of the ellipsoid. This enables the student to adjust the length of the third axis of each set of ellipsoids to obtain the desired center-to-center distance of the remaining four equal center-to-center distances as set forth as a ratio of the unit distance 'D', in Table I Section (d).

Also the toy is exemplified by a toy wherein the corner-to-corner edge distances of corresponding tetrahedron blocks and a corresponding octahedron on block are equal to the center-to-center distances of adjoining gravity stacked corresponding ellipsoidal elements in a corresponding space latticework. The corners of said corresponding tetrahedron blocks and said corresponding octahedron block are selected to form a corresponding latticework structure. There is a simple friction or torsion spring or velcro or pressure sensitive or suction cup or magnetic coupling arrangement in the four faces of each pair of corresponding tetrahedron blocks and in the eight faces of each corresponding octahedron block. This simple coupling arrangement enables the face in question to be connected to an exact corresponding face with equal edge lengths of either another corresponding tetrahedron block or another corresponding octahedron block.

Further, it is an object of the invention to demonstrate that latticework twinning in one plane may occur with any corresponding latticework, using corresponding tetrahedron blocks and corresponding octahedron blocks.

Still further, it is an object of the invention to demonstrate simultaneous latticework twinning in several of the imaginary thirteen nonparallel planes at the same time. All of the unique ratios of center-to-center distances and their corresponding corner-to-corner distances of corresponding tetrahedron blocks and corresponding octahedron blocks, set forth in Table I and Table II, demonstrate latticework structures that allow simultaneous twinning in at least two of the imaginary thirteen nonparallel planes of the basic latticework structure.

The corresponding tetrahedron and octahedron block sets optionally have orientation marks on their faces so that the 'up' corresponding tetrahedron and each of its four faces can be uniquely distinguished from its corresponding matching 'down' tetrahedron and each of its four faces and so that their corresponding matching octahedron may be uniquely oriented in relation to said pair of corresponding tetrahedrons and each of said octahedron's eight faces can be uniquely identified and oriented in relation to the eight matching faces on said pair of corresponding tetrahedron blocks. Further, indicia showing the polarity of spacepoints on said tetrahedron blocks and octahedron blocks optionally may be added.

BRIEF DESCRIPTION OF THE DRAWINGS

FIG. 1.0 is an illustration of a geometric ellipsoid.

FIG. 1.1 is an illustration of an ellipsoid generated by rotating an ellipse about a minor axis resulting in an oblate ellipsoid.

FIG. 1.2 is an illustration of an ellipsoid generated by rotating an ellipse about the major axis resulting in a prolate ellipsoid.

FIG. 1.3 is an illustration of an ellipsoid generated by rotating a circle about its diameter making an ellipsoid with equal axes.

FIG. 2.1 is the right hand view of the ellipsoidal element in FIG. 2.0.

FIG. 2.2 is a top view of the said ellipsoidal element as in FIG. 2.0 but with the triangular mark rotated toward the viewer so that the rectangular mark 113 is in the up direction when the gravity tray is in the plane of the sheet of paper.

FIG. 2.3 is the right hand view of said ellipsoidal element in FIG. 2.2.

FIG. 3.1 is an isometric view of the special torsion spring friction coupler 321, together with the special torsion spring inserting device 351 with a special torsion spring removing hook 353.

FIG. 3.2 is a top view of the gravity tray 301 with the first three ellipsoidal elements in a triangular or tetrahedral configuration shown in cross-section in that plane that passes through the common axis connector hole and the second connector hole and the third connector hole, with the special torsion spring inserting device 351 in the process of optionally inserting a special torsion spring friction coupler 321 between the third ellipsoidal element and the first ellipsoidal element along the second connector hole. Special torsion spring friction couplers 321 have already been used to optionally connect the common axis connector holes of the first ellipsoidal element and the second ellipsoidal element and to optionally connect the third connector holes of the third ellipsoidal element and the second ellipsoidal element.

FIG. 4.0 is a top view of the gravity tray with five ellipsoidal elements with their common axis connecting holes in alignment as indicated by the circle marks 109 pointing to the right away from the lowest corner 305 of the gravity tray 301 and touching the lefthand wall 313 at 202 and touching the front wall 311.

FIG. 4.1 is a top view of the gravity tray with nine ellipsoidal elements in a triangular configuration as indicated by the triangular marks 111 being in the up position. This view shows the center line of the common axis connector holes between the centerpoints of ellipsoidal elements 401 and 402; the center line of the second connector holes between the centerpoints of ellipsoidal elements 403 and 401; and the center line of the third connector holes between the centerpoints of ellipsoidal elements 403 and 402.

FIG. 4.2 is a top view of the gravity tray with thirteen ellipsoidal elements in a triangular tetrahedral configuration that enables the student to see that the fourth connector holes pass through the centerpoints of ellipsoidal elements 421 and 403; and to see that the fifth connector holes pass through the centerpoints of ellipsoidal elements 421 and 401 and to see that the sixth connector holes pass through the centerpoints of the ellipsoidal elements 421 and 402.

FIG. 4.3 is a top view of FIG. 4.2 with three more ellipsoidal elements added that enables the student to see that ellipsoidal element 410 is very similar to ellipsoidal element 402 but moved over two rows of ellipsoidal elements.

FIG. 4.4 is a top view of FIG. 4.3 with three more ellipsoidal elements added that enables the student to see that ellipsoidal elements 410 and 423 are gravity stacking in the same vertical plane as ellipsoidal element 402.

FIG. 4.5 is a top view of FIG. 4.4 with three more ellipsoidal elements added that enables the student to see that ellipsoidal elements 410, 411, 412, 423, 424, 902, 906, 907 and 908 are all in the same plane in a 3×3 configuration of the rectangular or square or pyramid (one-half octahedron) configuration. This enables the student to see the plane that the rectangular marks 113 should be in as indicated.

FIG. 4.6 is a top view of FIG. 4.5 with eight more ellipsoidal elements added.

FIG. 4.7 is a top view of FIG. 4.6 with the last five ellipsoidal elements added to complete the tetrahedral configuration with faces with five ellipsoidal elements on each edge.

FIG. 4.8 is a view of the completed tetrahedron in FIG. 4.7 that has been rotated forward about the common axis represented by ellipsoidal elements 401, 402, 405, 406 and 407 in such a manner that the tetrahedron edge represented by ellipsoidal elements 915, 914, 911, 905 and 415 is facing the viewer and is in the up rectangular position as indicated by the rectangular marks.

FIG. 4.9 is a view of FIG. 4.8 where ellipsoidal elements equal to one-eighth of an octahedron with faces with edges equal to five ellipsoidal elements have been added to show how a cube with diagonals equal to five ellipsoidal elements is formed from the tetrahedron in FIG. 4.8.

FIG. 5.0 is a top view of the gravity tray with five ellipsoidal elements in the rectangular or pyramid or (one-half octahedron) configuration as indicated by the rectangular marks being in the up position.

FIG. 5.1 is a top view of FIG. 5.0 with twenty additional ellipsoidal elements being added. The cross-section A—A is equal to one-eighth of an octahedral configuration base where the base has edges equal to five ellipsoidal elements or one-quarter of a pyramid base where the base has edges equal to five ellipsoidal elements, in a one-half octahedral configuration. This cross-section A—A enables the student to see where the ellipsoidal elements to change the tetrahedron of FIG. 4.8 to the cube of FIG. 4.9 are located in the one-eighth octahedron with face edges equal to five ellipsoidal elements.

FIG. 5.2 is a top view of FIG. 5.1 with four more ellipsoidal elements being added.

FIG. 5.3 is a top view of FIG. 5.2 with twelve more ellipsoidal elements being added.

FIG. 5.4 is a top view of FIG. 5.3 with nine more ellipsoidal elements being added to complete the third rectangular layer.

FIG. 5.5 is a top view of FIG. 5.4 with four more ellipsoidal elements being added to complete the fourth rectangular layer.

FIG. 5.6 is a top view of FIG. 5.5 with one more ellipsoidal element being added to complete the rectangular or pyramid configuration with faces with edges equal to five ellipsoidal elements, (one-half octahedron) configuration.

FIG. 6.0 is an isometric view of the cube with diagonals equal in length to five ellipsoidal elements. This view enables the student to better see how the seven ellipsoidal elements of the one-eighth octahedron as indicated by cross-section A—A closely pack on the tetrahedron of FIG. 4.7 and FIG. 4.8 to form the cube with diagonals equal to five ellipsoidal elements in FIG. 4.9 and FIG. 6.0.

FIG. 6.1 is an isometric view of the cuboctahedron with ellipsoidal elements designated with the letters A through M.

FIG. 7.0 is a top view of a corresponding 'up' tetrahedron and its matching inverted corresponding 'down' tetrahedron and their matching corresponding octahedron that connects said pair of tetrahedrons. This view identifies the corner spacepoints that are used to define the unique distance ratios between corner-to-corner spacepoints as set forth in the four Sections of Table II for these sets of matching corresponding tetrahedron and octahedron blocks. Each unique set of blocks have multiple twinning planes in their common imaginary thirteen nonparallel plane space latticework.

DESCRIPTION OF THE INVENTION

Figures 2, 3:
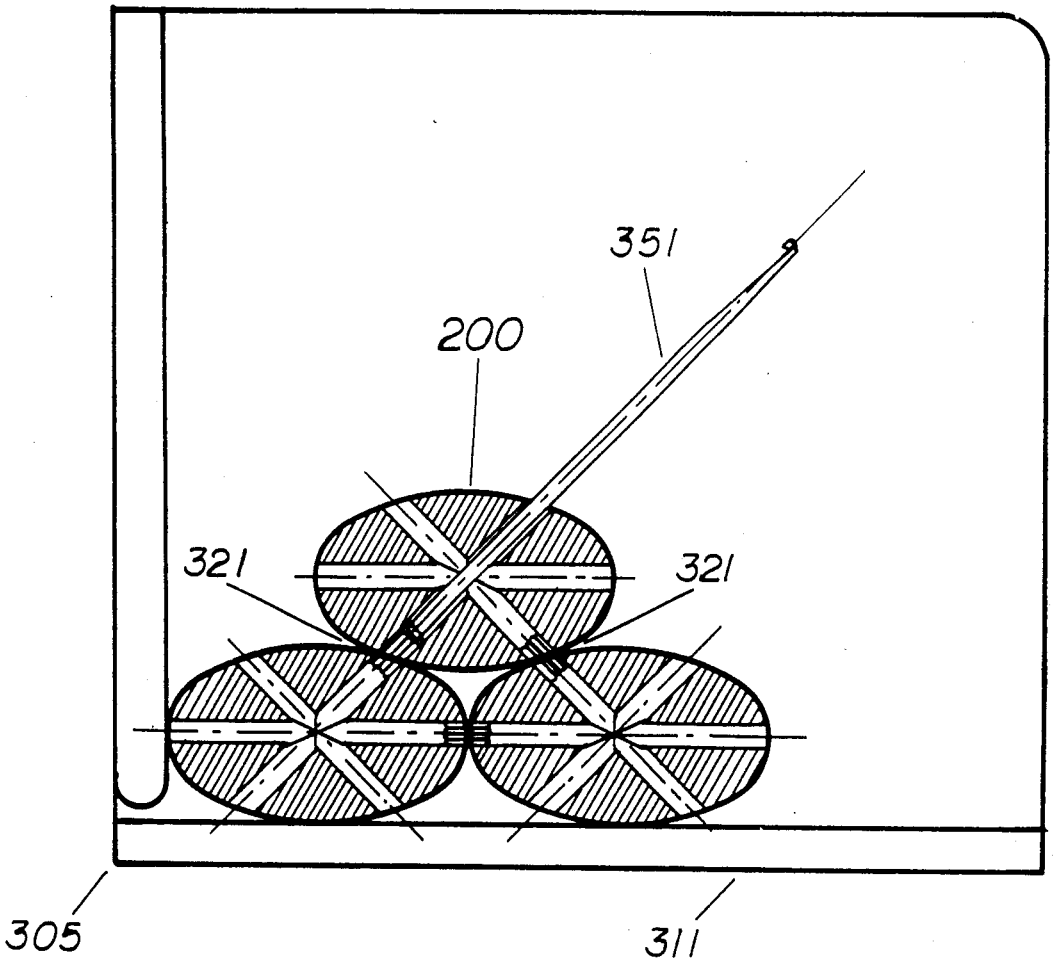
FIG. 2.0 is a top view of an ellipsoidal element in the triangular or tetrahedral configuration with the triangular mark 111 in the up direction when the gravity tray is in the plane of the sheet of paper with the circle mark 109 to the right.
FIG. 3.0 is an isometric view of the gravity tray 301 onto which ellipsoidal elements may be stacked. The tray 301 includes a surface 303 which is inclined toward a corner 305. Two walls 311 and 313 disposed atop surface 303 meet at the corner 305 to define a walled corner.

In FIG. 1.0, an ellipsoidal element 101 is shown. As is well-known in geometry, the ellipsoidal element 101 has a major axis (along the line y, in FIG. 1.0) and two minor axes (along the x line and the z line, in FIG. 1.0). The ellipsoid can also be described as having three orthogonal axes of symmetry.

In FIG. 2.0 an ellipsoidal element 200 (like ellipsoidal element 105 of FIG. 1.2 on its side) is shown as adapted for use in accordance with the invention.

It is first noted that six unique connector holes pass through the centerpoint of the ellipsoidal element 200. The common axis connector hole center line is denoted by endpoints 201 and 202, and is indicated by the common axis orientation circle mark 109. The triangular orientation mark or tetrahedral configuration mark 111 indicates the up position of the ellipsoidal element 200 when element 200 is in the triangular or tetrahedral configuration when the plane of the paper is equal to the surface 303 of the gravity tray as shown in FIG. 3.0.

The second connector hole center line is denoted by endpoints 203 and 204.

The third connector hole center line is denoted by endpoints 205 and 206.

The fourth connector hole center line is denoted by endpoints 207 and 208.

The fifth connector hole center line is denoted by endpoints 209 and 210.

The sixth connector hole center line is denoted by endpoints 211 and 212.

FIG. 2.1 is the righthand end view of FIG. 2.0.

FIG. 2.2 is the top view of the ellipsoidal element 200 when element 200 is in the rectangular or pyramidal (one-half octahedron) configuration as is indicated by the rectangular orientation mark 113 being in the up position when the plane of the paper is equal to surface 303 of the gravity tray in FIG. 3.0.

FIG. 2.3 is the righthand end view of FIG. 2.2.

Each of the six unique connector holes are located in such a manner that only identical connector holes optionally may be correctly coupled together. For example, the common axis connector holes between two properly oriented adjacent ellipsoidal elements 200, may optionally be coupled with the special torsion spring friction coupler without moving the gravity stacked position of the two elements 200 when properly oriented on the gravity tray 301 of FIG. 3.0 with the help of the special torsion spring friction coupler inserting device 351 of FIG. 3.1. The second connector holes of two properly oriented adjacent ellipsoidal elements 200 may optionally be coupled with the special torsion spring friction coupler without moving the gravity stacked position of the two elements 200 when properly oriented on the gravity tray 301.

Conversely, it is not possible to correctly orient and couple the common axis connector hole of one ellipsoidal element 200 with the second connector hole of an adjacent ellipsoidal element 200 either on or off of the gravity tray 301.

Alternately ellipsoidal elements 200 may be made without connector holes, with the three orientation marks or indicia. In this embodiment of the invention, magnetic elements, or velcro elements, or pressure sensitive adhesive couplers, or multiple suction cup couplers or other suitable coupling devices may optionally be used to couple adjacent ellipsoidal elements 200.

The six unique connector holes are also polarized so that only opposite ends of each unique connector hole can be correctly oriented to be optionally connected. This enables those skilled in the art to use a wide diversity of unique couplers in this invention, and it is an object of this invention to include all of these suitable unique coupling techniques within the scope of this invention.

Referring now to FIG. 3.0, a tray 301 is shown onto which ellipsoidal elements may be stacked. The tray 301 includes a surface 303 which is inclined toward a corner 305. Two walls 311 and 313 are disposed atop surface 303 and meet at the corner 305 to define a walled corner.

Alternately, in other embodiments of the invention, wall 313 may be positioned at different angles when gravity stacking complex ellipsoidal elements of influence, where multiple combinations of ellipsoidal surfaces are merged together and further where the common axis connector hole is not aligned with any of the axes of the ellipsoidal element.

In FIG. 4.7, a plurality of ellipsoidal elements embodied as ellipsoids of equal axes are stacked to form a basic tetrahedral configuration 400 which has four sides, or faces. Because ellipsoids of equal axes are being gravity stacked, the basic tetrahedral configuration is a regular tetrahedron of congruent sides. Moreover, the ellipsoids of equal axes are stacked closely packed where the aforementioned four conditions are satisfied as their common axis orientation circle marks are all pointing away from the lefthand wall 313, and their triangle orientation marks 111 or indicia are in the up direction from the surface 303 of tray 301. Due to the incline of the surface 303, the first ellipsoid 401 rests against the walled corner 305. The ellipsoids, it is noted, are gravity stacked. That is, a plurality of ellipsoids —such as those labelled 401, 402, 405, 406, 407, 409, 408, 404, 403, 410, 411, 412, 413, 414 and 415 form a bottom layer which rests on the surface 303 (see FIGS. 4.3, 4.6 and 4.7). An ellipsoid is properly oriented with its common axis orientation circle mark to the right and its triangular orientation mark up is gravity stacked atop each interstitial pocket between three ellipsoids in the lower layer to form a next layer. In this way the ellipsoids are closely packed under the aforementioned four conditions. In FIG. 4.7, ellipsoids such as 421, 422, 900, 901, 902, 424, 423, 903, 904 and 905 and the plane defined thereby form a second layer laying atop the lower layer. Additional layers are similarly formed by further stacking. The top ellipsoid 915, and the ellipsoids 401, 407 and 415 together form the four corners of a basic tetrahedral configuration gravity stacked five layers high. The six edges of the tetrahedral configuration 400 include the following ellipsoids respectively: (1) 401, 402, 405, 406 and 407; (2) 407, 409, 412, 414 and 415; (3) 401, 403, 410, 413 and 415; (4) 401, 421, 906, 912 and 915; (5) 407, 901, 908, 913 and 915; and (6) 915, 914, 911, 905 and 415.

Referring next to FIG. 4.8, the tetrahedral configuration 400 of FIG. 4.7 is again shown, however, oriented with a different bearing. Specifically, the tetrahedral configuration 400 is oriented with the rectangular orientation marks or square indicia facing upward. The thirty-five ellipsoids in tetrahedral configuration 400 in FIG. 4.7 have been optionally coupled along their six connector holes and rotated about the common axis of ellipsoids 401, 402, 405, 406 and 407 in such a manner that the top ellipsoid 915 is moved towards the bottom of FIG. 4.8. The numeral labels on the ellipsoids in FIG. 4.7 and 4.8 —which may also be provided on the ellipsoids in implementing the invention —aid in correctly orienting and positioning the ellipsoids in each bearing.

In FIG. 4.9, ellipsoids are added to the tetrahedral configuration 400 oriented as in FIG. 4.8. The ellipsoids labelled US combine with ellipsoids 905, 911, and 914 in order to form a four-edged face with $3\times3$ ellipsoid edges, each ellipsoid on the face having its square orientation indicia facing outward from the plane of the paper and its common axis orientation circle mark or indicia pointing to the right. Considering the 905-911-914 face as the base of a $3\times3$ base pyramid, it is noted that the ellipsoids 903, 904, 910 and 909 form a next layer. An additional ellipsoid in the interstitial pocket between ellipsoids 903, 904, 910 and 909 completes a $3\times3$ pyramid, (see ellipsoid 424 in FIG. 4.5 after examining FIG. 4.5). This is readily noticeable to a student by removing all but the above-referenced ellipsoids in the $3\times3$ pyramidal configuration. The commonality of latticework structure is thus demonstrated by adding ellipsoids to a tetrahedral configuration and then removing ellipsoids to derive a pyramidal (one-half octahedral) configuration.

FIG. 6.0 shows the cube of FIG. 4.9 from a different angle. Looking down onto the square orientation indicia of the cube in FIG. 4.9 and 6.0, the $3\times3$ pyramid base is observed while looking onto the triangle orientation indicia highlights the tetrahedral configuration, and the common axis orientation circle indicia is always pointing to the right when either the triangle orientation indicia or the square orientation indicia are considered to be in the up position.

Turning now to FIG. 5.1, ellipsoids of the invention are gravity stacked initially to form a four-sided base layer resting on the tray 301. The square orientation indicia of each ellipsoid faces up away from the tray 301. All common axis orientation circle indicia face the same direction in a recognizable pattern. Successive layers of ellipsoids are gravity stacked building up from the base layer. A five layer pyramid configuration 600 of ellipsoids is formed, the square orientation indicia of each ellipsoid facing upward, the triangle orientation indicia facing uniformly in one direction, and the common axis orientation circle indicia uniformly pointing to the right —as is shown in FIG. 5.6. The pyramid configuration 600 of FIG. 5.6 may be considered to be one-half of an octahedral configuration. To complete the octahedron, layers of ellipsoids may be placed below the base layer. That is, an arrangement of optionally connected ellipsoids below the base layer duplicates the arrangement above the base layer —thereby forming an octahedral configuration.

By comparing the face defined by ellipsoids 401, 402, 405, 406, 407, 403, 404, 408, 409, 410, 411, 412, 413, 414 and 415 of FIG. 5.6 with the back face of FIG. 4.8 which also is the base layer of FIG. 4.7 before it was rotated forward and also by checking the ellipsoids stacked in the base layer of 4.7 in FIGS. 4.3, 4.6 and 4.7, it is demonstrated to a student that a tetrahedron face can lie coextensive with an octahedron face. More specifically in FIG. 5.6, ellipsoids 401, 403, 410, 413 and 415 form a first edge; ellipsoids 415, 414, 412, 409 and 407 form a second edge; and ellipsoids 401, 402, 405, 406 and 407 form a third edge along both the back face of the configuration of FIG. 4.8 and the above-defined face of FIG. 5.6.

The congruency of faces also demonstrates that tetrahedrons and octahedrons can be interfit, or merged, to form a common lattice structure. The congruency of faces similarly demonstrates that ellipsoids arranged based on a tetrahedral configuration are, in actuality, arranged the same in relative positioning as ellipsoids stacked in a latticework founded on a pyramid configuration having a four-sided base in addition to four faces —the only difference being one of bearing (or orientation) and not lattice structure.

Alternatively, these aspects of latticework are demonstrated with reference again to FIG. 6.0. It is first noted that a student starts with the tetrahedral configuration having three edges defined by the ellipsoids 401, 421, 906, 912 and 915; 415, 905, 911, 914 and 915; and 407, 901, 908, 913 and 915 respectively. That is, the student starts with the arrangement of FIG. 4.8. It is next noted that laying coextensive against each face of the tetrahedral configuration is an ⅛th octahedron section readily derivable from the pyramid (one-half octahedron) configuration 600 of FIG. 5.6. The ⅛th octahedron sections are derived by cutting the pyramid configuration 600 with two imaginary planes that are perpendicular to the surface 303 of tray 301 and that lie along the two diagonals that are extensions of the cross-section A—A lines. For purposes of explanation, one ⅛th octahedron section will be examined as indicated by the cross-section A—A in FIG. 5.6. Ellipsoids 401 through 415 (and ellipsoids positioned thereunder) form a ⅛th octahedron section. Some of the ellipsoids —such as ellipsoid 415 —are shared by several sections but will nonetheless be maintained in its integrity with regard to the 401–415 ⅛th section. Examining the tetrahedral configuration of FIG. 4.8 shows that the upper back face thereof includes ellipsoids 401 through 415 as they are provided in FIG. 5.6. Further, these fifteen ellipsoidal elements all have their three orientation marks oriented in the same directions. Treating the 401–415 ellipsoids on the tetrahedron face as coexistent with the octahedron face and adding the ellipsoids to the octahedron face to complete the ⅛th octahedron section, a corner of the cube in FIGS. 4.9 and 6.0 is formed. The rear bottom corner of FIG. 6.0 is comprised of the 401–415 ellipsoids and ellipsoids 501, 601, 602, 603, 505, 506 and 514, (see FIGS. 5.3 and 5.4). In FIGS. 4.9 and 6.0, four correctly oriented ⅛th octahedron sections are added to the basic tetrahedral configuration to form the cube. The student will notice that the ⅛th octahedron section that can be added to a face of the tetrahedron and form a correctly oriented corner is very specific. Only one specific correctly oriented ⅛th octahedron section can be added to any specific face of the two corresponding tetrahedrons as shown in FIG. 7.0. That is, when an octahedron has been divided into eight, ⅛th octahedron sections, by passing planes through the extended cross-section lines of Section A—A of FIG. 5.6 and the plane of the paper, the student has eight distinctly differently oriented, ⅛th octahedron sections, each one of which can be correctly oriented and matched with one of the eight faces of two matching corresponding tetrahedrons. This also means that the two matching corresponding tetrahedrons are distinctly different from each other, one being the 'up' tetrahedron and the other being the 'down' tetrahedron, notwithstanding the initial intuitive feeling that they are the same when first glancing at FIG. 7.0 and looking at the blocks themselves. As noted previously, the cube demonstrates the continuity of latticework when ellipsoids in a tetrahedral configuration are interfit with ellipsoids in an octahedral configuration —i.e. that both embody the same latticework structure.

It will be noted also that the student may start with similarly dimensioned, similarly oriented ellipsoidal elements arranged in either one of the two basic configurations, either the basic tetrahedral configuration (FIG. 4.7) or the basic pyramid configuration (FIG. 5.6) to demonstrate commonality of latticework therebetween. In doing so, the student expands the initial latticework by adding ellipsoidal elements thereto. The student then selectively removes ellipsoidal elements from the expanded latticework to form the other basic configuration. This requires that the student add sufficient ellipsoidal elements to enable the forming of the other basic configuration. The student may be assisted by viewing the triangle, square, and circle orientation indicia applied to the ellipsoidal elements, as suggested in the FIG. 4.9 and FIG. 7.0 discussion above.

Still a further way of demonstrating the commonality of latticework between the tetrahedral configuration and the pyramid (one-half octahedron) configuration relates to FIG. 6.1. FIG. 6.1 depicts a cuboctahedron 700 formed of thirteen ellipsoids A through M. The commonality of latticework is readily shown by (a) adding ellipsoids to the cuboctahedron 700 to form a basic tetrahedral configuration and (b) also adding ellipsoids to the cuboctahedron 700 to arrive at a basic pyramid configuration —demonstrating that both have the same nucleus latticework. Alternatively, ellipsoids are removed from the five-layer configuration of FIG. 4.7 and of FIG. 5.6 to obtain the cuboctahedron in each case —again demonstrating common latticework. The positioning of the cuboctahedron ellipsoids A through M in the two configurations can be determined by starting with the cuboctahedron 700 in the rectangular or pyramidal (one-half octahedron) configuration and following the exact location of ellipsoidal elements denoted by letters A through M.

The bottom layer in FIG. 6.1 contains ellipsoids A, B, C and D in a form of a 4-sided square face. In FIG. 5.2 the student sees that ellipsoids 503, 504, 501 and 502 are equal to A, B, C and D of the cuboctahedron 700, and they are in the correct orientation. In FIG. 4.3 the student sees that ellipsoids 404, 408, 422 and 900 are equal to A, B, C and D of the cuboctahedron 700, and they are in the correct orientation.

The second layer of FIG. 6.1 contains ellipsoids E, F, G, H and I in the form of a cross. In FIG. 5.3 the student sees that ellipsoids 512, 508, 509, 510 and 506 are equal to E, F, G, H and I of the cuboctahedron 700, and they are in the correct orientation. In FIG. 4.5 the student sees that ellipsoids 411, 423, 424, 902 and 907 are equal to E, F, G, H and I of cuboctahedron 700, and they are in the correct orientation.

The third and top layer of FIG. 6.1 contains ellipsoids J, K, L and M in the form of a square face. In FIG. 5.4 the student sees that ellipsoids 516, 517, 514 and 515 are equal to J, K, L and M of the cuboctahedron 700, and they are in the correct orientation. In FIG. 4.6 the student sees that ellipsoids 903, 904, 909 and 910 are equal to J, K, L and M of cuboctahedron 700, and they are in the correct orientation.

The cuboctahedron 700 in FIGS. 5.2, 5.3, 5.4 and 5.5 is also of significance in demonstrating that the common latticework is arranged in imaginary thirteen nonparallel planes. The student can examine FIGS. 5.2, 5.3, 5.4 and 5.5 and identify the imaginary thirteen nonparallel planes that pass through the center ellipsoid 509 as follows:

(1) that plane that passes through the centerpoints of ellipsoids 509, 505, 506, 507, 508, 510, 511, 512 and 513 —this is surface 303 of tray 301 when the cuboctahedron 700 is in the rectangular configuration and the (x,y) plane in three-dimensional coordinates;

(2) that plane that passes through the centerpoints of ellipsoids 509, 508, 510, 518 and 519 —this is the (y,z) plane in three-dimensional coordinates;

(3) that plane that passes through the centerpoints of ellipsoids 509, 506, 512, 519 and 414 —this is the (x,z) plane in three-dimensional coordinates;

(4) that plane that passes through the centerpoints of ellipsoids 509, 508, 510, 501, 502, 516 and 517 —this plane is parallel to surface 303 when in the triangular or tetrahedral configuration;

(5) that plane that passes through the centerpoints of ellipsoids 509, 508, 510, 503, 504, 514 and 515;

(6) that plane that passes through the centerpoints of ellipsoids 509, 506, 512, 502, 504, 514 and 516;

(7) that plane that passes through the centerpoints of ellipsoids 509, 506, 512, 501, 503, 515 and 517;

(8) that plane that passes through the centerpoints of ellipsoids 509, 505, 513, 501, 504, 514 and 517;

(9) that plane that passes through the centerpoints of ellipsoids 509, 505, 513, 503 and 515;

(10) that plane that passes through the centerpoints of ellipsoids 509, 505, 513 502 and 516;

(11) that plane that passes through the centerpoints of ellipsoids 509, 507, 511, 502, 503, 515 and 516;

(12) that plane that passes through the centerpoints of ellipsoids 509, 507, 511, 501 and 517;

(13) that plane that passes through the centerpoints of ellipsoids 509, 507, 511, 504 and 514.

These imaginary thirteen nonparallel planes define the general common latticework structure that results when ellipsoids of influence are closely packed under the aforementioned four conditions.

FIG. 7.0 shows a corresponding octahedron being merged with a pair of matching corresponding tetrahedrons without any ellipsoidal elements being shown. FIG. 7.0, that is, shows a plurality of spacepoints 701, 702, 703 and 721, representing a first 'up' corresponding tetrahedron; and 722, 723, 724 and 704, representing the 'down' or inverted matching corresponding tetrahedron; and 821, 822, 823, 802, 803 and 804, representing their matching corresponding octahedron, which spacepoints define merged interfitting elements. The spacepoints define a latticework structure, such as a crystal lattice or the like. Preferably, the spacepoints correspond to the centerpoints of ellipsoidal elements —such as the ellipsoids illustrated in FIGS. 4.0 through 6.1. Also, preferably, all ellipsoidal elements are similarly dimensioned and similarly oriented as suggested in the ellipsoidal embodiment above.

However other structural members, such as the corresponding tetrahedrons and corresponding octahedrons with unique corner-to-corner distance ratios equal to center-to-center ellipsoid ratios as set forth in Table II, may be employed to define the center-to-center distances of ellipsoidal elements when imaginary thirteen nonparallel planes are involved. When twinning of any of the imaginary thirteen nonparallel planes is involved then the corresponding tetrahedrons and the corresponding octahedrons are the preferable embodiment of the invention. This feature is better understood by examining the unique ratios of center-to-center distances of ellipsoids in Table I and the corresponding unique corner-to-corner distances of tetrahedrons and octahedrons in Table II.

In Table I Sections (a) through (d), a variety of types of ellipsoid sets are listed together with the center-to-center distances that correspond to the sets. By examining FIGS. 4.0 through 6.1, it will be recognized that the center-to-center distances between adjacent touching ellipsoids is related to the lengths of the three orthogonal axes of symmetry of the similar ellipsoidal elements when the common axis and the location of either orientation mark are known. In all of the unique sets of ellipsoids referred to in Table I Sections (a) through (d) the length of the first axis of the corresponding ellipsoid is arbitrarily given the unit dimension 'D'. This first axis is also the common axis. The length of the second axis is given directly in Table I Sections (a) through (d) after the student studies the general arrangement required by the remaining center-to-center distances given in ratios of the unit distance 'D'. The orientation of the third axis is also determined by said general arrangement. The student may then vary the length of the third axis to make the remaining three or four equal length center-to-center distances match that distance as set forth in Table I Sections (a) through (d). Conversely, if a desired latticework is sought, the length of the orthogonal axes of symmetry may be selected accordingly. FIGS. 4.0 through 6.1 illustrate the equilateral ellipsoid set.

In Table II Sections (a) through (d), the distances between spacepoints in FIG. 7.0 are associated with pairs of matching corresponding tetrahedrons and their matching corresponding octahedron sets. While the spacepoint distances are preferably altered by employing ellipsoidal elements of selected dimensions, it is also contemplated that each edge shown in FIG. 7.0 be an edge on a set of matching corresponding tetrahedrons and their matching corresponding octahedron.

For example, to achieve the set of snowflake blocks, according to Table II Section (b), the tetrahedron and octahedron snowflake blocks are made with just one congruent triangular face. Each tetrahedron snowflake block has four of these congruent faces and the octahedron snowflake block has eight of these congruent faces. The snowflake congruent face has one edge that has arbitrarily been given a unit 'D' length between the spacepoint pairs as indicated in Table II Section (b). The other two edges of the snowflake congruent triangular face are of equal length and Table II Section (b) shows the spacepoint-to-spacepoint distance as a ratio of the given unit distance 'D' length. The snowflake congruent face has two edge lengths that are equal to the ratio of the square root of 5/4ths, substantially equal to (1.11803) multiplied by the unit distance 'D' length of the third edge. By using ratios to dimension the exact center-to-center distance between ellipsoids in Table I and exact spacepoint-to-spacepoint distance between corners in Table II the ellipsoids and the blocks can be made any size that is suitable to implement the invention. The ellipsoid numbers used in Table I and spacepoints used in Table II, correspond to the numbers used in FIG. 4.2 and FIG. 7.0 respectively.

The center-to-center distance ratios in Table I, and spacepoint-to-spacepoint distance ratios in Table II are unique and can be used to demonstrate simultaneous twinning in more than one of the imaginary thirteen nonparallel planes.

The ellipsoidal element embodiment, it is noted is more convenient, more demonstrative, and preferable in showing not only distances but also gravity stacking.

Any of various latticeworks —of tetrahedral and octahedral configurations —can be formed with ellipsoidal elements or with the corresponding tetrahedron and octahedron blocks as structure members for defining the spacing between spacepoints, especially according to the sets listed in Table II Sections (a) through (d). Moreover, the orientation of the imaginary thirteen nonparallel planes may vary but the planes still remain the exclusive set of imaginary thirteen nonparallel planes as long as no twinning occurs.

It is a further object of the invention, when using the tetrahedron and octahedron blocks of Table II, to demonstrate that the two touching congruent faces may be used to determine if twinning of the latticework structure is occurring. If one of the two touching congruent faces is on a tetrahedron block and the other touching congruent face is on an octahedron block, then no twinning of the latticework is occurring on that set of congruent faces. Conversely, if both touching congruent faces are on either two tetrahedron blocks or two octahedron blocks then twinning is occurring on that congruent face, excepting only when the set of blocks are of such dimensions or ratios that the octahedron block can be constructed from four tetrahedron blocks —such as is the case with the snowflake "SF4" blocks —in which case twinning may or may not be occurring since it is possible to connect four "SF4" tetrahedrons and cause these four tetrahedrons to appear to be a corresponding matching octahedron.

It is also an object of the invention to demonstrate that using one set of corresponding ellipsoids, which define one unique set of imaginary thirteen nonparallel planes in a space latticework, when closely packed under the aforementioned four conditions, which further define one unique set of one matching corresponding 'up' tetrahedron and one matching corresponding 'down' tetrahedron and their matching octahedron, when this set of ellipsoids can be simultaneously twinned in more than one of the imaginary thirteen nonparallel planes —such as with the snowflake blocks —it is possible to create literally millions of combinations of 'domains' of imaginary thirteen nonparallel plane space latticework where the combination of 'domains' make the resulting visible crystal structure appear completely different than just one simple imaginary thirteen nonparallel plane latticework structure made from just one ellipsoid of influence which has been twinned into many 'domains'.

Other improvements, modifications, and embodiments will become apparent to one of ordinary skill in the art upon review of this disclosure. Such improvements, modifications and embodiments are considered to be within the scope of this invention as defined in the following claims. For example, although it is preferred that the ellipsoidal elements be geometric ellipsoids, it is contemplated that the elements may be constructed with complex combinations of ellipsoidal surfaces that have been merged together and further that have a common axis that is not on one of the orthogonal axes of symmetry of the ellipsoidal elements. The coupling devices between the faces of the tetrahedrons and the octahedrons can be velcro, magnetic, pressure sensitive material, or any other suitable device or means of connecting the two congruent faces.

Another example would be to have the ellipsoid set be stacked by gravity as set forth in the invention and then expand the ellipsoidal surfaces into the interstilial spaces equally until the surfaces met the corresponding expanding surfaces of the adjacent ellipsoid. This creates a corresponding set of blocks with flat surfaces that can be stacked the way the ellipsoids of influence are stacked.

Further, the tetrahedron and octahedron blocks of the block sets as set forth in Table II Sections (a) through (d) can be divided in such a manner that a plane is made equidistant from each corner spacepoint and thus each tetrahedron block is cut into four pieces and each octahedron block is cut into six pieces that demonstrate the same planes above described for the corresponding ellipsoid. This again demonstrates the logical field of influence surrounding the unique ellipsoid sets of Table I and unique tetrahedron and octahedron block sets of Table II.

Also the tetrahedron and octahedron blocks of the block sets may be divided into parts along one of the thirteen nonparallel planes demonstrated by the invention, starting at one of the corner spacepoints and proceeding equidistant from the nearest remaining corner spacepoints, to demonstrate to the student how an ellipsoid of influence and the corresponding tetrahedrons and octahedrons could logically describe customary crystal latticework structures. Other similar solid shapes may also be employed in accordance with the claimed invention.

Conversely, a plurality of corresponding dimensioned blocks consisting of merged combinations of two or more corresponding tetrahedrons and octahedrons where no twinning is occurring are considered to be in the subject matter of the invention; for one specific example, an additional plurality of corresponding dimensioned blocks consisting of a merged first tetrahedron and octahedron along congruent faces containing spacepoints 721, 703 and 702 and 821, 803 and 802 and a second tetrahedron with the said octahedron along congruent faces containing spacepoints 721, 702 and 701 and 823, 804 and 803, where said spacepoints are as numbered in FIG. 7.0.

Further still, a plurality of corresponding dimensioned blocks consisting of merged combinations of two or more corresponding tetrahedrons and/or octahedrons where twinning is occurring are considered to be in the subject matter of the invention;

for example, an additional plurality of corresponding dimensioned blocks consisting of six merged 'Snowflake' tetrahedrons where six common axis edges 701-702 are merged and centered with a vertical bearing with the six opposite edges 703-721 away from said centered merged edges 701-702 in the shape of a hexagon when viewed along the 701-702 center axis —thus starting six 'domains' of imaginary 13 plane latticework with twinning in all six planes where six unmerged tetrahedrons would normally be touching;

another example is where three 'Snowflake' octahedrons are merged such that three edges 821-803 are merged and centered with a vertical bearing with the edges 823-822-802 in the shape of a hexagon when viewed along the 821-803 center axis —thus starting three 'domains' of imaginary 13 plane latticework with twinning in all three planes where three unmerged octahedrons would normally be touching;

still another example is where 20 'Icosahedron' tetrahedrons are merged such that twenty corners numbered 721 or 704 are touching forming a seed icosahedron —thus starting 20 'domains' of 13 plane latticework with twinning in all 30 planes where 20 unmerged tetrahedrons would normally be touching;

further still is where 5 'Icosahedron' tetrahedrons are merged such that 5 corners numbered 721 or 704 are touching and 5 edges like 721-703 or 704-722 are also merged in a central axis —thus making a 'cap like' combination that fits over the 5 twinned octahedrons that rest on each of the 12 points of the icosahedron.

TABLE I

Ellipsoids such that in FIG. 4.2 the Center-to-Center Distance Between Ellipsoid Numbers Section (a)

| Ellipsoid Set | 401 and 402 421 and 403 are | and | 403 and 401; 403 and 402 421 and 401; 421 and 402 are equal to |
|---|---|---|---|
| Equilateral Ellipsoids | Equal to Distance 'D' | | Distance 'D' |

Section (b)

| Ellipsoid Set | 401 and 402 421 and 403 are | and | 403 and 401; 403 and 402 421 and 401; 421 and 402 are equal to |
|---|---|---|---|
| Snowflake Ellipsoids | Equal to Distance 'D' | | 1.11803 times Distance 'D' |
| "SF3" Ellipsoids | Equal to Distance 'D' | | 0.76376 times Distance 'D' |
| "SF4" Ellipsoids | Equal to Distance 'D' | | 0.86603 times Distance 'D' |
| "SF5" Ellipsoids | Equal to Distance 'D' | | 0.98672 times Distance 'D' |
| "SF7" Ellipsoids | Equal to Distance 'D' | | 1.25618 times Distance 'D' |
| "SF8" Ellipsoids | Equal to Distance 'D' | | 1.39897 times Distance 'D' |

TABLE I-continued

Ellipsoids such that in FIG. 4.2 the Center-to-Center Distance Between Ellipsoid Numbers

| | | |
|---|---|---|
| "SF9" Ellipsoids | Equal to Distance 'D' | 1.54504 times Distance 'D' |
| "SF10" Ellipsoids | Equal to Distance 'D' | 1.69353 times Distance 'D' |
| "SF11" Ellipsoids | Equal to Distance 'D' | 1.84382 times Distance 'D' |
| "SF12" Ellipsoids | Equal to Distance 'D' | 1.99551 times Distance 'D' |

Section (c)

| Ellipsoid Set | 401 and 402 402 and 403 403 and 401 are | and | 401 and 421 402 and 421 403 and 421 are equal to |
|---|---|---|---|
| Cube Ellipsoids | Equal to Distance 'D' | | 0.70711 times Distance 'D' |
| Icosahedron Ellipsoids | Equal to Distance 'D' | | 0.95106 times Distance 'D' |
| Diamond Ellipsoids | Equal to Distance 'D' | | 0.61237 times Distance 'D' |

Section (d)

| Ellipsoid Set | 401 and 402 are | 421 and 403 are equal to | 403 and 401; 403 and 402 421 and 401; 421 and 402 are equal to |
|---|---|---|---|
| "SF3 × 4" Ellipsoids | Equal to Distance 'D' | 0.57735 times Distance 'D' | 0.64550 times Distance 'D' |
| "SF3 × 5" Ellipsoids | Equal to Distance 'D' | 0.41947 times Distance 'D' | 0.61427 times Distance 'D' |
| "SF3 × 6" Ellipsoids | Equal to Distance 'D' | 0.33333 times Distance 'D' | 0.60093 times Distance 'D' |
| "SF3 × 7" Ellipsoids | Equal to Distance 'D' | 0.27804 times Distance 'D' | 0.59385 times Distance 'D' |
| "SF3 × 8" Ellipsoids | Equal to Distance 'D' | 0.23915 times Distance 'D' | 0.58960 times Distance 'D' |
| "SF3 × 9" Ellipsoids | Equal to Distance 'D' | 0.21014 times Distance 'D' | 0.58683 times Distance 'D' |
| "SF3 × 10" Ellipsoids | Equal to Distance 'D' | 0.18759 times Distance 'D' | 0.58492 times Distance 'D' |
| "SF3 × 11" Ellipsoids | Equal to Distance 'D' | 0.16953 times Distance 'D' | 0.58354 times Distance 'D' |
| "SF3 × 12" Ellipsoids | Equal to Distance 'D' | 0.15470 times Distance 'D' | 0.58251 times Distance 'D' |
| "SF4 × 5" Ellipsoids | Equal to Distance 'D' | 0.72654 times Distance 'D' | 0.79496 times Distance 'D' |
| "SF4 × 6" Ellipsoids | Equal to Distance 'D' | 0.57735 times Distance 'D' | 0.76376 times Distance 'D' |
| "SF4 × 7" Ellipsoids | Equal to Distance 'D' | 0.48157 times Distance 'D' | 0.74698 times Distance 'D' |
| "SF4 × 8" Ellipsoids | Equal to Distance 'D' | 0.41421 times Distance 'D' | 0.73681 times Distance 'D' |
| "SF4 × 9" Ellipsoids | Equal to Distance 'D' | 0.36397 times Distance 'D' | 0.73015 times Distance 'D' |
| "SF4 × 10" Ellipsoids | Equal to Distance 'D' | 0.32492 times Distance 'D' | 0.72553 times Distance 'D' |
| "SF4 × 11" Ellipsoids | Equal to Distance 'D' | 0.29363 times Distance 'D' | 0.72219 times Distance 'D' |
| "SF4 × 12" Ellipsoids | Equal to Distance 'D' | 0.26795 times Distance 'D' | 0.71969 times Distance 'D' |
| "SF5 × 6" | Equal to | 0.79465 times | 0.93887 times |

TABLE I-continued

| Ellipsoids | Ellipsoids such that in FIG. 4.2 the Center-to-Center Distance Between Ellipsoid Numbers | | |
|---|---|---|---|
| Ellipsoids | Distance 'D' | Distance 'D' | Distance 'D' |
| "SF5 × 7" Ellipsoids | Equal to Distance 'D' | 0.66283 times Distance 'D' | 0.91293 times Distance 'D' |
| "SF5 × 8" Ellipsoids | Equal to Distance 'D' | 0.57012 times Distance 'D' | 0.89714 times Distance 'D' |
| "SF5 × 9" Ellipsoids | Equal to Distance 'D' | 0.50096 times Distance 'D' | 0.88676 times Distance 'D' |
| "SF5 × 10" Ellipsoids | Equal to Distance 'D' | 0.44721 times Distance 'D' | 0.87955 times Distance 'D' |
| "SF5 × 11" Ellipsoids | Equal to Distance 'D' | 0.40414 times Distance 'D' | 0.87432 times Distance 'D' |
| "SF5 × 12" Ellipsoids | Equal to Distance 'D' | 0.36880 times Distance 'D' | 0.87041 times Distance 'D' |
| "SF6 × 7" Ellipsoids | Equal to Distance 'D' | 0.83411 times Distance 'D' | 1.08348 times Distance 'D' |
| "SF6 × 8" Ellipsoids | Equal to Distance 'D' | 0.71744 times Distance 'D' | 1.06239 times Distance 'D' |
| "SF6 × 9" Ellipsoids | Equal to Distance 'D' | 0.63041 times Distance 'D' | 1.04850 times Distance 'D' |
| "SF6 × 10" Ellipsoids | Equal to Distance 'D' | 0.56278 times Distance 'D' | 1.03884 times Distance 'D' |
| "SF6 × 11" Ellipsoids | Equal to Distance 'D' | 0.50858 times Distance 'D' | 1.03182 times Distance 'D' |
| "SF6 × 12" Ellipsoids | Equal to Distance 'D' | 0.46410 times Distance 'D' | 1.02657 times Distance 'D' |
| "SF7 × 8" Ellipsoids | Equal to Distance 'D' | 0.86012 times Distance 'D' | 1.23002 times Distance 'D' |
| "SF7 × 9" Ellipsoids | Equal to Distance 'D' | 0.75579 times Distance 'D' | 1.21276 times Distance 'D' |
| "SF7 × 10" Ellipsoids | Equal to Distance 'D' | 0.67470 times Distance 'D' | 1.20075 times Distance 'D' |
| "SF7 × 11" Ellipsoids | Equal to Distance 'D' | 0.60972 times Distance 'D' | 1.19203 times Distance 'D' |
| "SF7 × 12" Ellipsoids | Equal to Distance 'D' | 0.55640 times Distance 'D' | 1.18549 times Distance 'D' |
| "SF8 × 9" Ellipsoids | Equal to Distance 'D' | 0.87870 times Distance 'D' | 1.37845 times Distance 'D' |
| "SF8 × 10" Ellipsoids | Equal to Distance 'D' | 0.78443 times Distance 'D' | 1.36416 times Distance 'D' |
| "SF8 × 11" Ellipsoids | Equal to Distance 'D' | 0.70888 times Distance 'D' | 1.35378 times Distance 'D' |
| "SF8 × 12" Ellipsoids | Equal to Distance 'D' | 0.64689 times Distance 'D' | 1.34600 times Distance 'D' |
| "SF9 × 10" Ellipsoids | Equal to Distance 'D' | 0.89271 times Distance 'D' | 1.52853 times Distance 'D' |
| "SF9 × 11" Ellipsoids | Equal to Distance 'D' | 0.80673 times Distance 'D' | 1.51653 times Distance 'D' |
| "SF9 × 12" Ellipsoids | Equal to Distance 'D' | 0.73618 times Distance 'D' | 1.50753 times Distance 'D' |
| "SF10 × 11" Ellipsoids | Equal to Distance 'D' | 0.90369 times Distance 'D' | 1.67994 times Distance 'D' |
| "SF10 × 12" Ellipsoids | Equal to Distance 'D' | 0.82466 times Distance 'D' | 1.66975 times Distance 'D' |
| "SF11 × 12" Ellipsoids | Equal to Distance 'D' | 0.91255 times Distance 'D' | 1.83245 times Distance 'D' |

TABLE II

| Tetrahedrons and Octahedrons such that in FIG. 7.0 the Spacepoint-to-Spacepoint Distance Between Corners Numbered | | | |
|---|---|---|---|
| | Section (a) | | |
| Tetrahedron and Octahedron Sets | 701 and 702<br>703 and 721<br>723 and 724<br>704 and 722<br>803 and 821<br>804 and 822<br>803 and 804<br>821 and 822<br>are | and | 703 and 701; 703 and 702<br>721 and 701; 721 and 702<br>722 and 723; 722 and 724<br>704 and 723; 704 and 724<br>823 and 803; 823 and 804<br>823 and 821; 823 and 822<br>802 and 803; 802 and 804<br>802 and 821; 802 and 822<br>are equal to |
| Equilateral Blocks | Equal to Distance 'D' | | Distance 'D' |
| | Section (b) | | |
| Tetrahedron and Octahedron Sets | 701 and 702<br>703 and 721<br>723 and 724<br>704 and 722<br>803 and 821<br>804 and 822<br>803 and 804<br>821 and 822<br>are | and | 703 and 701; 703 and 702<br>721 and 701; 721 and 702<br>722 and 723; 722 and 724<br>704 and 723; 704 and 724<br>823 and 803; 823 and 804<br>823 and 821; 823 and 822<br>802 and 803; 802 and 804<br>802 and 821; 802 and 822<br>are equal to |
| Snowflake Blocks | Equal to Distance 'D' | | 1.11803 times Distance 'D' |
| "SF3" Blocks | Equal to Distance 'D' | | 0.76376 times Distance 'D' |
| "SF4" Blocks | Equal to Distance 'D' | | 0.86603 times Distance 'D' |
| "SF5" Blocks | Equal to Distance 'D' | | 0.98672 times Distance 'D' |
| "SF7" Blocks | Equal to Distance 'D' | | 1.25618 times Distance 'D' |
| "SF8" Blocks | Equal to Distance 'D' | | 1.39897 times Distance 'D' |
| "SF9" Blocks | Equal to Distance 'D' | | 1.54504 times Distance 'D' |
| "SF10" Blocks | Equal to Distance 'D' | | 1.69353 times Distance 'D' |
| "SF11" Blocks | Equal to Distance 'D' | | 1.84382 times Distance 'D' |
| "SF12" Blocks | Equal to Distance 'D' | | 1.99551 times Distance 'D' |
| | Section (c) | | |
| Tetrahedron and Octahedron Sets | 701 and 702; 702 and 703<br>703 and 701; 723 and 724<br>724 and 722; 722 and 723<br>821 and 822; 822 and 823<br>823 and 821; 802 and 803<br>803 and 804; 804 and 803<br>are | | 721 and 701; 721 and 702<br>721 and 703; 704 and 722<br>704 and 723; 704 and 724<br>802 and 821; 802 and 822<br>803 and 821; 803 and 823<br>804 and 822; 804 and 823<br>are equal to |
| Cube Blocks | Equal to Distance 'D' | | 0.70711 times Distance 'D' |
| Icosahedron Blocks | Equal to Distance 'D' | | 0.95106 times Distance 'D' |
| Diamond Blocks | Equal to Distance 'D' | | 0.61237 times Distance 'D' |
| | Section (d) | | |
| | 701 and 702<br>723 and 724 | | 721 and 701; 721 and 702<br>703 and 701; 703 and 702<br>722 and 723; 722 and 724<br>704 and 723; 704 and 724 |

TABLE II-continued

| Tetrahedrons and Octahedrons such that in FIG. 7.0 the Spacepoint-to-Spacepoint Distance Between Corners Numbered | | | |
|---|---|---|---|
| Tetrahedron and Octahedron Sets | 821 and 822 803 and 804 are | 721 and 703 704 and 722 803 and 821 804 and 822 are equal to | 802 and 821; 802 and 822 802 and 803; 802 and 804 823 and 821; 823 and 822 823 and 803; 823 and 804 are equal to |
| "SF3 × 4" Blocks | Equal to Distance 'D' | 0.57735 times Distance 'D' | 0.64550 times Distance 'D' |
| "SF3 × 5" Blocks | Equal to Distance 'D' | 0.41947 times Distance 'D' | 0.61427 times Distance 'D' |
| "SF3 × 6" Blocks | Equal to Distance 'D' | 0.33333 times Distance 'D' | 0.60093 times Distance 'D' |
| "SF3 × 7" Blocks | Equal to Distance 'D' | 0.27804 times Distance 'D' | 0.59385 times Distance 'D' |
| "SF3 × 8" Blocks | Equal to Distance 'D' | 0.23915 times Distance 'D' | 0.58960 times Distance 'D' |
| "SF3 × 9" Blocks | Equal to Distance 'D' | 0.21014 times Distance 'D' | 0.58683 times Distance 'D' |
| "SF3 × 10" Blocks | Equal to Distance 'D' | 0.18759 times Distance 'D' | 0.58492 times Distance 'D' |
| "SF3 × 11" Blocks | Equal to Distance 'D' | 0.16953 times Distance 'D' | 0.58354 times Distance 'D' |
| "SF3 × 12" Blocks | Equal to Distance 'D' | 0.15470 times Distance 'D' | 0.58251 times Distance 'D' |
| "SF4 × 5" Blocks | Equal to Distance 'D' | 0.72654 times Distance 'D' | 0.79496 times Distance 'D' |
| "SF4 × 6" Blocks | Equal to Distance 'D' | 0.57735 times Distance 'D' | 0.76376 times Distance 'D' |
| "SF4 × 7" Blocks | Equal to Distance 'D' | 0.48157 times Distance 'D' | 0.74698 times Distance 'D' |
| "SF4 × 8" Blocks | Equal to Distance 'D' | 0.41421 times Distance 'D' | 0.73681 times Distance 'D' |
| "SF4 × 9" Blocks | Equal to Distance 'D' | 0.36397 times Distance 'D' | 0.73015 times Distance 'D' |
| "SF4 × 10" Blocks | Equal to Distance 'D' | 0.32492 times Distance 'D' | 0.72553 times Distance 'D' |
| "SF4 × 11" Blocks | Equal to Distance 'D' | 0.29363 times Distance 'D' | 0.72219 times Distance 'D' |
| "SF4 × 12" Blocks | Equal to Distance 'D' | 0.26795 times Distance 'D' | 0.71969 times Distance 'D' |
| "SF5 × 6" Blocks | Equal to Distance 'D' | 0.79465 times Distance 'D' | 0.93887 times Distance 'D' |
| "SF5 × 7" Blocks | Equal to Distance 'D' | 0.66283 times Distance 'D' | 0.91293 times Distance 'D' |
| "SF5 × 8" Blocks | Equal to Distance 'D' | 0.57012 times Distance 'D' | 0.89714 times Distance 'D' |
| "SF5 × 9" Blocks | Equal to Distance 'D' | 0.50096 times Distance 'D' | 0.88676 times Distance 'D' |
| "SF5 × 10" Blocks | Equal to Distance 'D' | 0.44721 times Distance 'D' | 0.87955 times Distance 'D' |
| "SF5 × 11" Blocks | Equal to Distance 'D' | 0.40414 times Distance 'D' | 0.87432 times Distance 'D' |
| "SF5 × 12" Blocks | Equal to Distance 'D' | 0.36880 times Distance 'D' | 0.87041 times Distance 'D' |
| "SF6 × 7" Blocks | Equal to Distance 'D' | 0.83411 times Distance 'D' | 1.08348 times Distance 'D' |
| "SF6 × 8" Blocks | Equal to Distance 'D' | 0.71744 times Distance 'D' | 1.06239 times Distance 'D' |
| "SF6 × 9" Blocks | Equal to Distance 'D' | 0.63041 times Distance 'D' | 1.04850 times Distance 'D' |
| "SF6 × 10" Blocks | Equal to Distance 'D' | 0.56278 times Distance 'D' | 1.03884 times Distance 'D' |
| "SF6 × 11" Blocks | Equal to Distance 'D' | 0.50858 times Distance 'D' | 1.03182 times Distance 'D' |
| "SF6 × 12" Blocks | Equal to Distance 'D' | 0.46410 times Distance 'D' | 1.02657 times Distance 'D' |
| "SF7 × 8" Blocks | Equal to Distance 'D' | 0.86012 times Distance 'D' | 1.23002 times Distance 'D' |
| "SF7 × 9" Blocks | Equal to Distance 'D' | 0.75579 times Distance 'D' | 1.21276 times Distance 'D' |
| "SF7 × 10" Blocks | Equal to Distance 'D' | 0.67470 times Distance 'D' | 1.20075 times Distance 'D' |
| "SF7 × 11" Blocks | Equal to Distance 'D' | 0.60972 times Distance 'D' | 1.19203 times Distance 'D' |
| "SF7 × 12" Blocks | Equal to Distance 'D' | 0.55640 times Distance 'D' | 1.18549 times Distance 'D' |
| "SF8 × 9" Blocks | Equal to Distance 'D' | 0.87870 times Distance 'D' | 1.37845 times Distance 'D' |
| "SF8 × 10" Blocks | Equal to Distance 'D' | 0.78443 times Distance 'D' | 1.36416 times Distance 'D' |
| "SF8 × 11" Blocks | Equal to Distance 'D' | 0.70888 times Distance 'D' | 1.35378 times Distance 'D' |
| "SF8 × 12" Blocks | Equal to Distance 'D' | 0.64689 times Distance 'D' | 1.34600 times Distance 'D' |
| "SF9 × 10" Blocks | Equal to Distance 'D' | 0.89271 times Distance 'D' | 1.52853 times Distance 'D' |
| "SF9 × 11" Blocks | Equal to Distance 'D' | 0.80673 times Distance 'D' | 1.51653 times Distance 'D' |
| "SF9 × 12" Blocks | Equal to Distance 'D' | 0.73618 times Distance 'D' | 1.50753 times Distance 'D' |
| "SF10 × 11" Blocks | Equal to Distance 'D' | 0.90369 times Distance 'D' | 1.67994 times Distance 'D' |
| "SF10 × 12" Blocks | Equal to Distance 'D' | 0.82466 times Distance 'D' | 1.66975 times Distance 'D' |
| "SF11 × 12" Blocks | Equal to Distance 'D' | 0.91255 times Distance 'D' | 1.83245 times Distance 'D' |

I claim:

1. A method of teaching characteristics of latticework structure comprising the steps of:

demonstrating the commonality of lattice structure of (a) latticework arranged in accordance with a tetrahedron configuration and (b) latticework arranged in accordance with a pyramid configuration which has (i) a four-edge base and (ii) four faces that extend from the base and meet at a point, said demonstrating step including the steps of:

positioning a plurality of structural members relative to each other to define spacepoints in a latticework arranged in accordance with the tetrahedron configuration; and positioning a plurality of structural members relative to each other to define spacepoints in a latticework arranged in accordance with the pyramid configuration;

wherein said positioning steps include:

merging together structural members along at least one face of the latticework arranged in accordance with the tetrahedron configuration with structural members along at least one corresponding face of the latticework arranged in accordance with the pyramid configuration to make the spacepoints along at least one tetrahedron face coexistent with the spacepoints on the at least one corresponding pyramid face.

2. A method according to claim 1 wherein each said positioning step includes the step of:

gravity stacking a plurality of at least substantially similarly dimensioned, similarly oriented ellipsoidal elements wherein each ellipsoidal element is one of the structural members and the centerpoint of each ellipsoidal element is a spacepoint in the latticework;

all stacked ellipsoidal elements having at least substantially similar dimensions.

3. A method according to claim 2 wherein said pyramid configuration stacking step includes the step of:

stacking ellipsoidal elements to form a one-eighth octahedron section that includes one face of a pyramid configuration; and wherein said merging step includes the step of:

merging the pyramid face of the one-eighth octahedron section with a face of the latticework arranged in accordance with the tetrahedron configuration;

said merging resulting in at least a substantially uniform latticework structure.

4. A method according to claim 3 wherein said demonstrating step includes a further step of:

applying indicia to the ellipsoidal elements;

the indicia being applied and located on the stacked ellipsoidal elements so that the indicia on the ellipsoidal elements display a first identifiable pattern when the latticework is oriented to the first bearing and a second identifiable pattern when the latticework is oriented to a second bearing with a common axis indicia that is oriented in the same bearing in said first bearing and said second bearing.

5. A method according to claim 2 wherein said gravity stacking step includes the step of stacking similarly dimensioned spheroids, the centerpoint of each spheroid being a spacepoint in the latticework.

6. A method according to claim 2 comprising the further step of:

selecting the ellipsoidal element dimensions to have a major axis and two minor axes of prescribed relative lengths that define the latticework structure, the major axis and two minor axes determining the distance between adjacent spacepoints in the latticework.

7. A method as claimed in claim 6 wherein the positioning step includes the step of:

forming the latticework in space of sufficient ellipsoidal elements that the latticework spacepoints define thirteen nonparallel planes in space, each plane being defined by a plurality of coplanar ellipsoidal elements that contact a given ellipsoidal element.

8. A method according to claim 2 wherein said gravity stacking step includes the stacking of magnetically interacting ellipsoids.

9. A method according to claim 2 wherein the positioning step includes the step of:

forming the latticework in space of sufficient ellipsoidal elements that the latticework spacepoints define thirteen nonparallel planes in space, each plane being defined by a plurality of coplanar ellipsoidal elements that contact a given ellipsoidal element.

10. A method according to claim 1 comprising a further step of:

selecting the dimensions of the structural members to determine prescribed distances between each spacepoint in the latticework and spacepoints adjacent to said given spacepoint, the dimensions of the structural members which define inter-spacepoint distances defining the latticework structure, said distances substantially as set forth in Table II Sections (a) through (d), where numbered spacepoints are those in FIG. 7.0 where the common axis is through spacepoints 701 and 702 and the distance between spacepoints 701 and 702 is equal to unit distance 'D'.

11. A method for teaching latticework characteristics comprising the step of:

demonstrating the commonality of internal lattice structure between similarly dimensioned, similarly oriented ellipsoidal elements arranged to form (a) a tetrahedron configuration and (b) a pyramid configuration having (i) a base and (ii) four sides, when such configurations are extended in space;

wherein the commonality demonstrating step comprises the steps of:

coupling ellipsoidal elements together to form a cuboctahedral type configuration characterized by having twelve ellipsoidal elements touching one ellipsoidal element;

orienting the ellipsoidal elements in said cuboctahedral type configuration to a first prescribed bearing;

selectively stacking additional ellipsoidal elements relative to the ellipsoidal elements that are coupled and oriented to the first prescribed bearing to form the tetrahedron configuration;

orienting the ellipsoidal elements in said cuboctahedral type configuration to a second prescribed bearing; and selectively stacking additional ellipsoidal elements relative to the ellipsoidal elements that are coupled and oriented to the second prescribed bearing to form the pyramid configuration having a base and four sides.

12. An educational device for teaching characteristics of latticework structure comprising:

sets of structural members of suitable material, consisting of a plurality of similarly dimensioned tetrahedral structural members and a plurality of similarly dimensioned octahedral structural members;

said structural members having suitable means for connecting congruent faces to each other.

13. An educational device according to claim 12 wherein;

said structural members have suitable markings which indicate the non-twinning orientation of each face of each pair of tetrahedral structural members in relation to the appropriate congruent face of their matching octahedral structural member.

14. An educational device according to claim 13 wherein;

the corner-to-corner distances of said structural members, being essentially equal to the center-to-center distances of spacepoints on said latticework structure where the corner-to-corner distances are substantially equal to the ratios of unit distance 'D' as set forth in claim Table II Sections (a) through (d), where numbered spacepoints are those in FIG. 7.0 where the common axis is through spacepoints 701 and 702 and the distance between spacepoints 701 and 702 is substantially equal to unit distance 'D'.

15. An educational toy for teaching characteristics of imaginary thirteen nonparallel plane latticework structure comprising:

a plurality of similarly dimensioned ellipsoidal elements, each ellipsoidal element being dimensionally characterized by three orthogonal axes of symmetry and a curved surface in which every plane cross section is an ellipse or a circle, one of said axes being marked as a common axis with a suitable similar indicia on the ellipsoidal surface indicating the correct orientation or bearing of said common axis; and each ellipsoidal element having a suitable similar indicia on the ellipsoidal surface indicating the correct triangular or tetrahedral orientation of the ellipsoidal element when correctly gravity stacked on a gravity tray, or placed in an imaginary thirteen nonparallel plane latticework structure; and each ellipsoidal element having a suitable similar indicia on the ellipsoidal surface indicating the correct pyramidal or octahedral orientation of the ellipsoidal element when correctly gravity stacked on a gravity tray, or placed in a imaginary thirteen nonparallel plane latticework structure; and each ellipsoidal element having six uniquely oriented polarized connecting holes through the centerpoint thereof;

where said six uniquely oriented polarized connecting holes may optionally be connected to an identical uniquely oriented polarized connecting hole in a correctly oriented adjacent ellipsoidal element, without either ellipsoidal element being removed from its correct gravity stacked position on the gravity tray, with a special torsion spring friction coupling device with the aid of a special torsion spring friction coupling insertion tool;

said six uniquely oriented polarized connecting holes allowing a similarly oriented corresponding ellipsoidal element to optionally be connected to each polarized end, thus twelve similarly oriented corresponding ellipsoidal elements may optionally be connected to one central corresponding ellipsoidal element in the shape of a simple cuboctahedral type configuration, using special torsion spring friction couplers and a special torsion spring friction insertion tool.

16. An educational toy according to claim 15 wherein ellipsoidal elements of said plurality are connected to form a latticework having a tetrahedral configuration with the cuboctahedral type configuration as a nucleus portion thereof; and wherein ellipsoidal elements of said plurality are connected to form a latticework having a five-sided pyramid configuration with the cuboctahedral type configuration as a nucleus portion thereof.

17. An educational toy according to claim 16 further comprising:

a tray for supporting said ellipsoidal elements connected in either configuration;

a side of said either configuration lying on said tray when supported thereby.

18. An educational toy according to claim 17 wherein said tray includes a surface and a walled corner on the surface, said walled corner being characterized by a front vertical wall and a vertical side wall that is perpendicular to said front vertical wall, said surface being inclined toward said walled corner.

19. An educational device according to claim 18 wherein the said tray includes a said vertical side wall that may be positioned at an angle to said front vertical wall.

20. An educational toy according to claim 18 wherein each ellipsoidal element has indicia thereon which orient the ellipsoidal element with relation to the said perpendicular side wall of said walled corner of said tray regardless of which configuration the said ellipsoidal element is in and a second and third indicia thereon which face one direction when said ellipsoidal elements are supported on said tray in one configuration and which face another direction when said ellipsoidal elements are supported on said tray in the other configuration.

21. An educational toy according to claim 20 wherein the indicia on each ellipsoidal element includes a triangle, a square and a circle positioned on each ellipsoidal element; and wherein said triangle on each ellipsoidal element lies parallel to said tray surface when said ellipsoidal elements are supported in a tetrahedral configuration; and wherein said square on each ellipsoidal element lies parallel to said tray surface when said ellipsoidal elements are supported in a pyramid configuration; and wherein center of said circle points the same away in relation to said perpendicular side wall when said ellipsoidal elements are supported in either the said tetrahedral configuration or the said pyramid configuration.

22. An educational device according to claim 20 wherein the centerpoints of said ellipsoidal elements define spacepoints; and wherein said ellipsoidal elements are connected by suitable means while being supported on the said tray so that the spacepoints are characterized by a geometric latticework structure formed of only octahedron sections and tetrahedron sections merged together.

23. A device according to claim 22 wherein a number of spacepoints form a rhombohedron geometric latticework which includes two tetrahedrons and an octahedron positioned therebetween, a face of each tetrahedron lying coextensively against a corresponding face of said octahedron.

24. A device according to claim 23 wherein;

one edge of one tetrahedron with spacepoints numbered 701 and 702 in FIG. 7.0 has been designated the common axis edge, said edge having a length from corner-to-corner substantially equal to unit distance 'D' and the other edge lengths from corner-to-corner substantially equal to the ratio of said unit distance 'D' as set forth in Table II Sections (a) through (d), where numbered spacepoints are those in FIG. 7.0.

25. An educational device according to claim 20 wherein said ellipsoidal elements are positioned to form a rhombohedral group with each edge of said rhombohedral group comprising an equal number of said elements, said equal number being at least three, and from said rhombohedral group forming an "up" tetrahedral group, a "down" tetrahedral group and an octahedral group similar to FIG. 7.0, and demonstrating that the "up" tetrahedral group merges correctly with the octahedral group in only four unique ways, and demonstrating that the "down" tetrahedral group merges correctly with the octahedral group in only four unique ways, and demonstrating that none of the four general faces of the "up" tetrahedral group can be correctly merged with any of the four general faces of the "down" tetrahedral group.

26. An educational device according to claim 25 comprising two said rhombohedral groups, and from said rhombohedral groups forming two "up" tetrahedral groups, two "down" tetrahedral groups and two octahedral groups, and demonstrating that none of the four general faces of one "up" tetrahedral group can be merged correctly with any of the four general faces of the other "up" tetrahedral group, or with any of the four general faces of the "down" tetrahedral groups, and demonstrating that none of the four general faces of one "down" tetrahedral group can be merged correctly with any of the four general faces of the other "down" tetrahedral group, or with any of the four general faces of the "up" tetrahedral groups, and demonstrating that none of the eight general faces of one octahedral group be can be merged correctly with any of the eight general faces of the other octahedral group, thus demonstrating that twinning of the general latticework structure occurs when a general face of one tetrahedral group is merged with a similar general face of an essentially similar second tetrahedral group, and demonstrating that twinning of the latticework structure occurs when a general face of one octahedral group is merged with a similar general face of an essentially similar second octahedral group.

27. A device according to claim 15 wherein said three orthogonal axes of symmetry are of such lengths that the center-to-center distances of the ellipsoidal elements are substantially equal to the ratios as set forth in Table I Sections (a) through (d), where the ellipsoids in Table I are as shown in FIG. 4.2.

28. An educational device according to claim 27 wherein said three orthogonal axes of symmetry are of such lengths that the center-to-center distances of the ellipsoidal elements as shown in FIG. 4.2, for the "Rhombus 30" ellipsoid set are as follows:

401 to 402 and 403 to 421 are dimensions substantially equal to the unit distance 'D', and 401 to 421 and 403 are dimensions substantially equal to 1.61803 times the unit distance 'D', and 401 to 403 and 402 to 421 are dimensions substantially equal to 1.47337 times the unit distance 'D', and are of such lengths that the center-to-center distances of the ellipsoidal elements as shown in FIG. 4.2, for the "Isosceles 60" ellipsoid set are as follows:

401 to 402 is a dimension substantially equal to the unit distance 'D', and 401 to 403 and 403 to 402 are dimensions substantially equal to 0.89800 times the unit distances 'D', and 401 to 421, 402 to 421 and 403 to 421 are dimensions substantially equal to 1.40126 times the unit distance 'D', and are of such lengths that the center-to-center distances of the ellipsoidal elements as shown in FIG. 4.2, for the "Edge 60" ellipsoid set are as follows:

401 to 402 is a dimension substantially equal to the unit distance 'D', and 403 to 421 is a dimension substantially equal to 1.53884 times the unit distance 'D', and 401 to 421 and 421 to 402 are dimensions substantially equal to 1.40126 times the unit distance 'D', and 401 to 403 and 403 to 402 are dimensions substantially equal to 0.95106 times the unit distance 'D'.

29. An educational toy according to claim 15 wherein the set comprises thirteen spheres arranged in a cubotahedron configuration of spheres.

30. An educational toy according to claim 15 further comprising:

a first plurality of twenty-two separate spheres stackable with the cuboctahedron configuration to form a regular tetrahedron configuration.

31. An educational toy according to claim 30 further comprising:

a second plurality of seventeen separate spheres stackable with the cuboctahedron configuration to form a regular pyramid configuration with congruent sides.

32. An educational device for teaching chracteristics of imaginary thirteen nonparallel plane latticework structure comprising:

a plurality of similarly dimensioned matching sets of corresponding tetrahedral and octahedral structural elements, each said matching set consisting of an 'up' tetrahedral element, a matching 'down' tetrahedral element and a matching octahedral element;

each said matching set being dimensionally characterized by one edge of the base of the 'up' tetrahedral being marked as the common axis with a suitable similar indicia indicating the correct orientation or bearing of said edge of said matching set, said edge having a length from corner-to-corner designated a unit distance 'D' and the other edge lengths from corner-to-corner designated as a ratio of said unit distance 'D' substantially as set forth in Table II Sections (a) through (d), where numbered spacepoints are those in FIG. 7.0;

each face of said matching set being marked with suitable similar indicia indicating the correct orientation of that face in relation to its corresponding face on the appropriate opposite matching structural element of said set, in an imaginary thirteen nonparallel plane latticework structure; and each face of said matching set being fit with suitable means to attach said face to either an appropriate congruent corresponding face on a matching opposite structural element of said set or of a similar set, when no twining is occurring in the latticework structure; and each face of said matching set being fit with suitable means to attach said face optionally to a congruent face on a similar matching structural element of said set or of a similar set when twinning of the common latticework is being demonstrated.

33. An educational device according to claim 32 wherein the edge distances between the numbered corner spacepoints in FIG. 7.0 for the "Rhombus 30" tetrahedron and octahedron set are as follows:

701 to 702, 703 to 721, 704 to 722, 723 to 724, 803 to 804, 804 to 822, 822 to 821 and 821 to 803 are dimensions substantially equal to each other, and 701 to 721, 702 to 703, 704 to 724, 722 to 723, 802 to 803, 803 to 823, 823 to 822 and 822 to 802 are dimensions substantially equal to each other, and 701 to 703, 702 to 721, 704 to 723, 722 to 724, 802 to 804, 804 to 823, 823 to 821 and 821 to 802 are dimensions substantially equal to each other, and where thirty corner spacepoints numbered 802 in FIG. 7.0 can be merged together in one point making solid around said one point, and the edge distances between the numbered corner spacepoints in FIG. 7.0 for the "Isosceles 60" tetrahedron and octahedron set are as follows:

701 to 702, 723 to 724, 803 to 804 and 821 to 822 are dimensions substantially equal to each other, and 701 to 703, 703 to 702, 723 to 722, 722 to 724, 803 to 802, 802 to 804, 821 to 823 and 823 to 822 are dimensions substantially equal to each other, and 701 to 721, 702 to 721, 703 to 721, 722 to 704, 723 to 704, 724 to 704, 802 to 821, 821 to 803, 803 to 823, 823 to 804, 804 to 822 and 822 to 802 are dimensions substantially equal to each other, and where sixty corner spacepoints numbered 721 can be merged together in one point making a solid around said one point, and the edge distances between the numbered corner spacepoints in FIG. 7.0 for the "Edge 60" tetrahedron and octahedron set are as follows:

701 to 702, 723 to 724, 803 to 804 and 821 to 822 are dimensions substantially equal to each other, and 703 to 721, 704 to 722, 803 to 821 and 804 to 822 are dimensions substantially equal to each other, and 701 to 721, 721 to 702, 723 to 704, 704 to 724, 803 to 823, 823 to 804, 821 to 802 and 803 to 822 are dimensions substantially equal to each other, and 701 to 703, 703 to 702, 723 to 722, 722 to 724, 803 to 802, 802 to 804, 821 to 823 and 823 to 822 are dimensions substantially equal to each other, and where sixty corner spacepoints numbered 721 can be merged together in the point making a solid around said one point.

34. An educational device according to claim 32 wherein the edge distances between the numbered corner spacepoints in FIG. 7.0 for the "Rectangular Rotation" tetrahedron and octahedron sets are as follows:

701 to 702, 703 to 721, 704 to 722, 723 to 724, 803 to 804, 803 to 821, 804 to 822 and 821 to 822 are dimensions substantially equal to each other, and 703 to 701, 703 to 702, 721 to 701, 721 to 702, 722 to 723, 722 to 724, 704 to 723, 704 to 724, 823 to 803, 823 to 804, 823 to 821, 823 to 822, 802 to 803, 802 to 804, 802 to 821 and 802 to 822 are dimensions substantially equal to each other, and where a given whole number of three or nore corner spacepoints numbered 802 in FIG. 7.0 can be merged together with two times the said given wholenumber of corner spacepoints numbered 701 in FIG. 7.0 in one point making a solid around said one point, and the edge distances between the numbered corner spacepoints in FIG. 7.0 for the "Triangular Rotation" tetrahedron and octahedron sets are as follows:

701 to 702, 702 to 703, 703 to 701, 723 to 724, 724 to 722, 722 to 723, 821 to 822, 822 to 823, 823 to 821, 802 to 803, 803 to 804 and 804 to 802 are dimensions substantially equal to each other, and 721 to 701, 721 to 702, 721 to 703, 704 to 722, 704 to 723, 704 and 724, 802 to 821, 802 to 822, 803 to 831, 803 to 823, 804 to 822 and 804 to 823 are dimensions substantially equal to each other, and where a whole number of corner spacepoints numbered 721 can be merged together in one point making a solid around said one point, and the edge distances between the numbered corner spacepoints in FIG. 7.0 for the "Rectangular Ellipsoid" tetrahedron and octahedron sets are as follows:

701 to 702, 723 to 724, 821 to 822 and 803 to 804 are dimensions substantially equal to each other, and 721 to 703, 704 to 722, 803 to 821, and 804 to 822 are dimensions substantially equal to each other, and 721 to 701, 721 to 702, 703 to 701, 703 to 702, 722 to 723, 722 to 724, 704 to 723, 704 to 724, 802 to 821, 802 to 822, 802 to 803, 802 to 804, 823 to 821, 823 to 822, 823 to 803 and 823 to 804 are dimensions substantially equal to each other, and where a first given whole number of three or more corner spacepoints numbered 823 in FIG. 7.0 can be merged together with two times the said first given whole number of corner spacepoints numbered 721 in FIG. 7.0 in one point making a solid around said one point, and where a different second given whole number of four or more corner spacepoints numbered 823 in FIG. 7.0 can be merged together with two times the said second given whole number of corner spacepoints numbered 701 to FIG. 7.0 in a second point making a solid around said second point.

35. An educational device according to claim 32 wherein the edge distances between the numbered corner spacepoints in FIG. 7.0 for the "General Ellipsoid" tetrahedron and octahedron sets are as follows:

701 to 702, 723 to 724, 803 to 804 and 821 to 822 are dimensions substantially equal to each other, and 701 to 703, 722 to 724, 821 to 823 and 802 to 804 are dimensions substantially equal to each other, and 702 to 703, 722 to 723, 802 to 803 and 822 to 823 are dimensions substantially equal to each other, and 701 to 721, 704 to 724, 802 to 822 and 803 to 823 are dimensions substantially equal to each other, and 702 to 721, 704 to 723, 802 to 821 and 804 to 823 are dimensions substantially equal to each other, and 703 to 721, 704 to 722, 803 to 821 and 804 to 822 are dimensions substantially equal to each other, and where corners of four tetrahedrons and corners of three octahedrons may be merged together at one point making a plane surface passing through said one point, said corners being numbered 701, 702, 703, 704, 802, 803 and 804 in FIG. 7.0.

36. An educational method comprising the step of:

demonstrating the commonality of internal lattice structure between equal diameter spheroids arranged to form (a) a regular tetrahedron configuration and (b) a pyramid configuration having (i) an equilateral base and (ii) four congruent sides, when such configurations are extended in space;

wherein the commonality demonstrating step includes the steps of:

forming the tetrahedron configuration of spheroids and the pyramid configuration of spheroids to have the same number of layers; and coupling at least one side of the pyramid configuration to a corresponding one of the tetrahedron faces comprising the step of defining the spheroids along each said at least one side of the pyramid configuration to be the spheroids along each corresponding tetrahedron face.

37. An educational method according to claim 36 wherein commonality demonstrating step comprises the further step of:

dividing the pyramid into four equal ⅛th octahedron sections with two planes passing diagonally across and perpendicular to the pyramid base, spheroids common to a plurality of the ⅛th octahedron sections being represented in each such ⅛th octahedron section as whole spheroids.

38. An educational method according to claim 37 wherein the coupling comprises the further step of:

merging each pyramid side of each ⅛th octahedron section to a corresponding tetrahedron face.

39. An educational device for teaching characteristics of latticework structure comprising:

sets of structural members of suitable material, comprising a plurality of similarly dimensioned tetrahedral structural members and a plurality of similarly dimensioned octahedral structural members, where the ratio of said structural members in said sets is essentially two tetrahedral structural members for each octahedral structural member; and said sets of structural members having a designated common axis edge on one edge of the tetrahedrons, which edge has a length substantially equal to the unit distance 'D'; and said sets of structural members having corner-to-corner dimensions substantially as set forth in Table II Sections (a) through (d); and an additional plurality of corresponding structural members comprising one-half octahedron structural members made by passing a single plane through any one of the three planes with four spacepoints therein, resulting in a structural member containing five spacepoints of the original six spacepoints of the corresponding octahedron structural member; and an additional plurality of corresponding structural members comprising first one-quarter octahedron structural members made by passing two planes through any two of the three planes with four spacepoints therein, resulting in a structural member containing four spacepoints of the original six spacepoints of the corresponding octahedron structural member; and an additional plurality of corresponding structural members comprising second one-quarter octahedron structural members made by passing two planes through any two opposite spacepoints, with each plane passing through a different third spacepoints equidistance on the edges made by the other four spacepoints of the original six spacepoints of the corresponding octahedron structural member, resulting in a structural member containing three spacepoints of the original six spacepoints of the corresponding octahedron structural member; and an additional plurality of corresponding structural members comprising first one-eighth octahedron structural members made by passing three planes through the three planes with four spacepoints therein, resulting in a structural member containing three spacepoints of the original six spacepoints of the corresponding octahedron structural member; and an additional plurality of corresponding structural members comprising one-half tetrahedron structural members made by passing a plane through two of the four spacepoints of the tetrahedron and a third spacepoint equidistance on the edge defined by the two remaining spacepoints of the said corresponding tetrahedron structural member, resulting in a structural member containing three spacepoints of the original four spacepoints of the corresponding tetrahedron structural member; and said structural members having suitable means for connecting congruent faces to each other; and said structural members having suitable markings which indicate the proper orientation of each face of each structural member in relation to the face of each other structural member.

40. An educational device according to claim 39 demonstrating the shape of the effective ellipsoid of influence in imaginary thirteen nonparallel plane space latticework structure when said ellipsoid of influence is expanded into the interstices therebetween wherein;

an additional plurality of corresponding structural members comprising said second one-eighth octahedron structural members made by passing four planes that are parallel to the original four sets of parallel planes of the original octahedron and equidistance between those corresponding sets of parallel planes, resulting in six structural members each containing one spacepoint of the original six spacepoints of the corresponding octahedron structural member; and an additional plurality of corresponding structural members comprising one-quarter tetrahedron structural members made by passing six planes into the center of a corresponding tetrahedron structural member where each plane passes through a point on each edge equidistance from first two spacepoints on ends of said edge and tangent to the corresponding ellipsoids touching at said point, each said plane stopping when it intersects another said plane, resulting in four structural members each containing one spacepoint of the original four spacepoints of the corresponding tetrahedron structural member; and said structural members having suitable means for connecting congurent faces to each other; and said structural members having suitable markings which indicate the proper orientation of each face of each structural member in relation to the face of each other structural member.

41. An educational device according to claim 40 wherein:

an additional plurality of corresponding structural members comprising merged combinations of two or more tetrahedral and octahedral structural members where no twinning has occurred.

42. An educational device according to claim 41 wherein:

an additional plurality of corresponding structural members comprising merged combinations of two or more tetrahedral and octahedral structural members where twinning is occurring.

43. An educational method comprising the steps of:

demonstrating the commonality of internal lattice structure between equal diameter spheres arranged to form (a) a regular tetrahedron configuration and (b) a pyramid configuration having (i) an equilateral base and (ii) four congurent sides, when such configurations are extended in space;

wherein the commonality demonstrating step comprises the further steps of:

packing equal diameter spheres relative to each other to form a cuboctahedron configuration;

orienting the spheres in the cubotahedron configuration in a first prescribed manner;

selectively stacking additional equal diameter spheres relative the spheres that are packed and oriented in said first prescribed manner to form a regular tetrahedron configuration;

orienting the spheres in the cuboctahedron configuration in a second prescribed manner; and selectively stacking additional equal diameter spheres relative to the spheres that are packed and oriented in said second prescribed manner to form a pyramid configuration having a four-sided equilateral base and four equal sides.

44. A method of teaching characteristics of latticework structure comprising the steps of:

demonstrating the commonality of lattice structure of (a) latticework extending from a basic tetrahedron first configuration and (b) latticework extending from a basic pyramid second configuration which has a (i) four-edged base and (ii) four sides that extend from the base and meet at a point, said demonstrating step including the steps of:

positioning a plurality of structure members relative to each other to define spacepoints in a latticework arranged in one of the two basic configurations;

adding structural members to expand the latticework arranged in said one basic configuration; and removing structural members from the expanded latticework to define spacepoints in a latticework arranged in the other of the two basic configurations.

45. A method according to claim 44 wherein said positioning step includes the step of:

gravity stacking a plurality of at least substantially similarly dimensioned, similarly oriented ellipsoidal elements, wherein each ellipsoidal element is one of the structural members and the centerpoint of each ellipsoidal element is a spacepoint in the latticework.

46. An educational device for teaching characteristics of latticework structure comprising:

sets of structural members of suitable material, comprising a plurality of similarly dimensioned tetrahedral structural members and a plurality of similarly dimensioned octahedral structural members, said structural members having congruent faces and means for connecting congruent faces of said structural members together.

47. An educational device according to claim 46 wherein said sturctural members are positioned to form a helix.

48. An educational device according to claim 46 wherein said structural members are positioned to form a spiral.

49. An educational device according to claim 46 wherein said structural members are positioned to form a helical like spiral.

50. An educational device according to claim 46 wherein said structural members are positioned to form a tetrahedron.

51. An educational device according to claim 46 wherein said structural members are positioned to form an octahedron.

52. An educational device according to claim 46 wherein said structural members are positioned to form a rhombohedron.

53. An educational device according to claim 46 wherein said structural members are positioned to form a geometrical configuration.

54. An educational device according to claim 46 wherein said structural members are positioned to form a three dimensional geometric form.

55. An educational device for teaching characteristics of imaginary thirteen nonparallel plane latticework structure comprising:

a plurality of ellipsoidal elements of substantially equal size and shape with similar dimensions and indicia, and each said element having a common axis essentially passing through its center with a suitable common axis indicia at one end, and each said element having a suitable rotation indicia placed perpendicular to said common axis on the surface of said element, and demonstrating that when said elements are positioned with a similar bearing with one end of each common axis touching the oppostie end of the common axis of an adjacent said element, and where all common axes are parallel and all rotational indicia have the same bearing, when twinning does not occur, the centers of said elements define one unique latticework structure, wherein twinning does not occur when elements are oriented with the same bearing and positioned so their common axes are touching, and first three equal sets of elements positioned along their common axes are merged together so that each element is touching three other elements, and each additional element is positioned touching at least four other elements where said four other elements are in a plane, or each additional element is positioned touching at least one other common axis, or each additional element is positioned touching at least three other elements where said three other elements are touching each other in a plane, and no other element is already touching said three other elements.

56. An educational device according to claim 55 wherein the elements have a complex ellipsoidal shape where all planes through the center of said complex ellipsoidal element cut the surface of element in the form of segments of a circle or segments of an ellipse merged together so that a line tangent to the surface of the element is also tangent to both segments where the segments meet.

* * * * *